US009962953B2

(12) United States Patent
Tanizaki

(10) Patent No.: US 9,962,953 B2
(45) Date of Patent: May 8, 2018

(54) PRINTING DEVICE HAVING PRESSING PARTS FOR STABLY PRESSING CASSETTES DESPITE DEFORMATION OF COVER

(71) Applicant: Brother Kogyo Kabushiki Kaisha, Nagoya-shi, Aichi-ken (JP)

(72) Inventor: Masashi Tanizaki, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/291,131

(22) Filed: Oct. 12, 2016

(65) Prior Publication Data

US 2017/0182792 A1 Jun. 29, 2017

(30) Foreign Application Priority Data

Dec. 25, 2015 (JP) ..... 2015-254221

(51) Int. Cl.
*B41J 2/325* (2006.01)

(52) U.S. Cl.
CPC ..... *B41J 2/325* (2013.01)

(58) Field of Classification Search
None
See application file for complete search history.

(56) References Cited

U.S. PATENT DOCUMENTS 5,431,504 A * 7/1995 Beadman ..... B41J 3/4075 400/234
6,485,206 B1 11/2002 Takahashi
7,654,760 B2 * 2/2010 Sakano ..... B41J 3/4075 400/582

FOREIGN PATENT DOCUMENTS

JP 2006-056263 A 3/2006

* cited by examiner

*Primary Examiner* — Matthew Luu
*Assistant Examiner* — Tracey McMillion
(74) *Attorney, Agent, or Firm* — Banner & Witcoff, Ltd.

(57) ABSTRACT

A printing device includes: a main body having an attachment surface; first and second mounting sections formed in the attachment surface respectively for detachably receiving first and second cassettes; first and second print parts; a body cover having an opposing surface; first and second pressing parts protruding from the opposing surface respectively toward the first and second mounting sections; first and second engaging parts provided at the main body; and third and fourth engaging parts provided at the body cover and engageable with the first and second engaging parts. A first center of gravity of load that the mounted first cassette applies to the first pressing part and a second center of gravity of load that the mounted second cassette applies to the second pressing part are located within a specific area on the opposing surface defined by virtual lines passing through locations on the third and fourth engaging parts.

20 Claims, 15 Drawing Sheets

PRINTING DEVICE HAVING PRESSING PARTS FOR STABLY PRESSING CASSETTES DESPITE DEFORMATION OF COVER

CROSS REFERENCE TO RELATED APPLICATION

This application claims priority from Japanese Patent Application No. 2015-254221 filed Dec. 25, 2015. The entire content of the priority application is incorporated herein by reference.

TECHNICAL FIELD

The present disclosure relates to a printing device.

BACKGROUND

Conventionally, there is known a printing device that employs an ink ribbon accommodated in a cassette to print characters and the like on a printing medium. It is necessary to ensure that the positioning of the cassette is stable when the cassette is mounted in the printing device in order for the printing device to perform reliable printing on the printing medium. As an example, Japanese Patent Application Publication No. 2006-56263 discloses a conventional printing device that includes a mounting section and a cover. The cassette is mounted in the mounting section. The cover is configured to cover the mounting section from above and can open and close thereon. First through fourth pressing members are disposed on the cover. When the cover is closed over the mounting section, the first through fourth pressing members press the cassette into the mounting section, thereby stabilizing the position of the cassette when the cassette is mounted in the printing device.

SUMMARY

It is desirable for printing devices to support a plurality of types of cassettes, a plurality of types of printing media, and the like. In such cases, the printing device may conceivably be provided with two mounting sections. However, the cover for a printing device provided with two mounting sections has a larger surface area than a cover for a printing device provided with only one mounting section. A cover with a larger surface area is more susceptible to warping and other deformation. If the cover deforms, the first through fourth pressing members may be unable to press the cassette properly into the mounting section. As a result, the positioning of the cassette in the mounting section may become unstable. When the positioning of the cassette is not stable, the printing device is less likely to be able to execute reliable printing on the printing media.

In view of the foregoing, it is an object of the present disclosure to provide a printing device capable of stabilizing the position of a cassette mounted in a mounting section, even when the cover over the mounting section becomes deformed.

In order to attain the above and other objects, the disclosure provides a printing device including: a main body; a first mounting section; a second mounting section; a first print part; a second print part; a body cover, a first pressing part; a second pressing part; a first engaging part; a second engaging part; a third engaging part; and a fourth engaging part. The main body has an attachment surface. The first mounting section is provided as a recess formed in the attachment surface, a first cassette being configured to be detachably mounted in the first mounting section, the first cassette accommodating a first ink ribbon therein. The second mounting section is provided as a recess formed in the attachment surface, the first mounting section and the second mounting section being formed at positions different from each other in the attachment surface, a second cassette being configured to be detachably mounted in the second mounting section, the second cassette accommodating a second ink ribbon therein. The first print part is configured to perform printing on a first print medium through the first ink ribbon. The second print part is configured to perform printing on a second print medium through the second ink ribbon. The body cover is movable between an open position and a closed position relative to the main body, the body cover having an opposing surface configured to oppose the attachment surface, the opposing surface of the body cover in the open position exposing the first mounting section and the second mounting section, the opposing surface of the body cover in the closed position covering the first mounting section and the second mounting section, the body cover having a first edge and a second edge opposite to each other in a first direction parallel to the opposing surface, the body cover having a third edge and a fourth edge opposite to each other in a second direction crossing the first direction and parallel to the opposing surface. The first pressing part protrudes from the opposing surface, the first pressing part protruding toward the first mounting section and being configured to press the first cassette mounted in the first mounting section when the body cover is in the closed position, a first load center of gravity being defined as a center of gravity of load that the first cassette mounted in the first mounting section applies to the first pressing part when the body cover is in the closed position. The second pressing part protrudes from the opposing surface, the second pressing part protruding toward the second mounting section and being configured to press the second cassette mounted in the second mounting section when the body cover is in the closed position, a second load center of gravity being defined as a center of gravity of load that the second cassette mounted in the second mounting section applies to the second pressing part when the body cover is in the closed position. The first engaging part and the second engaging part are provided at the main body. The third engaging part is provided at the body cover and is configured to engage the first engaging part when the body cover is in the closed position, the third engaging part being positioned closer to the first edge of the body cover than the first load center of gravity and the second load center of gravity are to the first edge of the body cover in the first direction. The fourth engaging part is provided at the body cover and is configured to engage the second engaging part when the body cover is in the closed position, the fourth engaging part being positioned closer to the second edge of the body cover than the first load center of gravity and the second load center of gravity are to the second edge of the body cover in the first direction. The first load center of gravity and the second load center of gravity are located within a specific area on the opposing surface, the specific area being enclosed by a first virtual line, a second virtual line, a third virtual line and a fourth virtual line, the first virtual line passing through a first location and a second location, the second virtual line passing through a third location and a fourth location, the third virtual line passing through the first location and the third location, the fourth virtual line passing through the second location and the fourth location. The first location is a point on the third engaging part positioned closest to the first edge of the body cover in the first direction and closest to the third edge of the body cover in the second direction, the second location being a point on the fourth engaging part positioned closest to the second edge of the body cover in the first direction and closest to the third edge of the body cover in the second direction, the third location being a point on the third engaging part positioned closest to the first edge of the body cover in the first direction and closest to the fourth edge of the body cover in the second direction, and the fourth location being a point on the fourth engaging part positioned closest to the second edge of the body cover in the first direction and closest to the fourth edge of the body cover in the second direction.

According to another aspect, the disclosure provides a printing device including: a main body; a first mounting section; a second mounting section; a first print part; a second print part; a body cover, a first pressing part; a second pressing part; a first engaging part; a second engaging part; a third engaging part; and a fourth engaging part. The main body has an attachment surface. The first mounting section is provided as a recess formed in the attachment surface, a first cassette being configured to be detachably mounted in the first mounting section, the first cassette accommodating a first ink ribbon therein. The second mounting section is provided as a recess formed in the attachment surface, the first mounting section and the second mounting section being formed at positions different from each other in the attachment surface, a second cassette being configured to be detachably mounted in the second mounting section, the second cassette accommodating a second ink ribbon therein. The first print part is configured to perform printing on a first print medium through the first ink ribbon. The second print part is configured to perform printing on a second print medium through the second ink ribbon. The body cover is movable between an open position and a closed position relative to the main body, the body cover having an opposing surface configured to oppose the attachment surface, the opposing surface of the body cover in the open position exposing the first mounting section and the second mounting section, the opposing surface of the body cover in the closed position covering the first mounting section and the second mounting section, the body cover having a first edge and a second edge opposite to each other in a first direction parallel to the opposing surface, the body cover having a third edge and a fourth edge opposite to each other in a second direction crossing the first direction and parallel to the opposing surface. The first pressing part protrudes from the opposing surface, the first pressing part protruding toward the first mounting section and being configured to press the first cassette mounted in the first mounting section when the body cover is in the closed position, a first load center of gravity being defined as a center of gravity of load that the first cassette mounted in the first mounting section applies to the first pressing part when the body cover is in the closed position. The second pressing part protrudes from the opposing surface, the second pressing part protruding toward the second mounting section and being configured to press the second cassette mounted in the second mounting section when the body cover is in the closed position, a second load center of gravity being defined as a center of gravity of load that the second cassette mounted in the second mounting section applies to the second pressing part when the body cover is in the closed position. The first engaging part and the second engaging part are provided at the main body. The third engaging part is provided at the body cover and is configured to engage the first engaging part when the body cover is in the closed position, the third engaging part being positioned closer to the first edge of the body cover than the first load center of gravity and the second load center of gravity are to the first edge of the body cover in the first direction. The fourth engaging part is provided at the body cover and is configured to engage the second engaging part when the body cover is in the closed position, the fourth engaging part being positioned closer to the second edge of the body cover than the first load center of gravity and the second load center of gravity are to the second edge of the body cover in the first direction. The first load center of gravity and the second load center of gravity are located within a specific area on the opposing surface, the specific area being an area defined by connecting a first location of the third engaging part, a second location of the fourth engaging part, a third location of the third engaging part and a fourth location of the fourth engaging part. The first location is a part of the third engaging part positioned closest to the first edge of the body cover in the first direction and closest to the third edge of the body cover in the second direction, the second location being a part of the fourth engaging part positioned closest to the second edge of the body cover in the first direction and closest to the third edge of the body cover in the second direction, the third location being a part of the third engaging part positioned closest to the first edge of the body cover in the first direction and closest to the fourth edge of the body cover in the second direction, and the fourth location being a part of the fourth engaging part positioned closest to the second edge of the body cover in the first direction and closest to the fourth edge of the body cover in the second direction.

DETAILED DESCRIPTION

Hereinafter, a printing device 1 according to an embodiment of the present disclosure will be described while referring to the accompanying drawings. In the following description, upper-left, lower-right, lower-left, upper-right, upper, and lower sides (directions) in FIG. 1 correspond to the left, right, front, rear, top, and bottom of the printing device 1.

First, a general structure of the printing device 1 will be described with reference to FIGS. 1 and 2.

Figure 3:
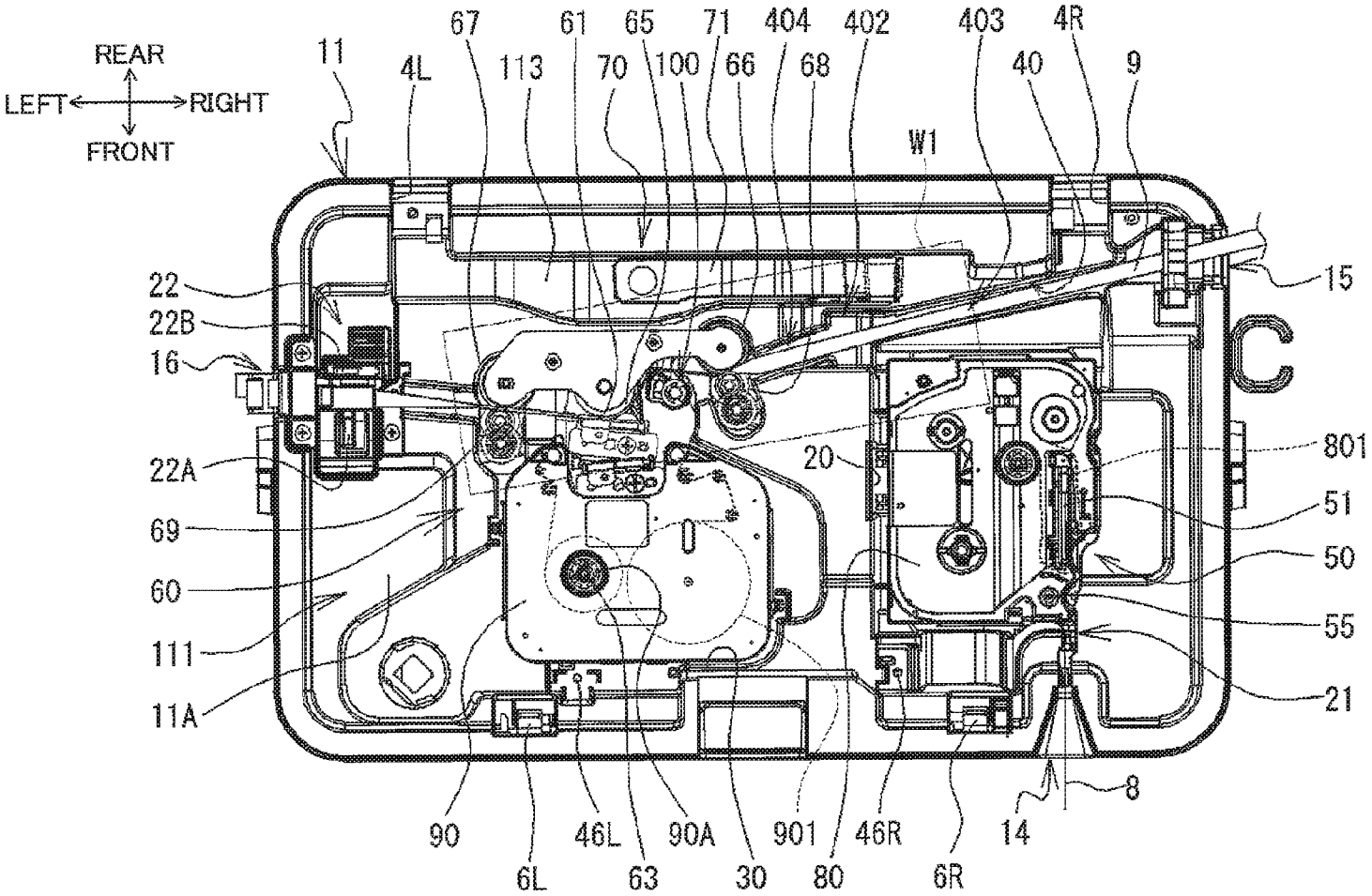
FIG. 3 is a plan view of a housing body of the printing device according to the embodiment.

The printing device 1 is capable of printing characters on two forms of printing media via ink ribbons 801 and 901 (see FIG. 3). Specifically, in the present embodiment, the printing media are a tape 8 and a tubing (or a tube) 9 (see FIG. 3). The tape 8 has a strip shape, while the tubing 9 has an elongated cylindrical shape. The characters include letters, symbols, and the like. Note that the types of printing media are not limited to the examples in this embodiment. For example, both printing media may be tape 8 or both may be tubing 9. Both the ink ribbon 801 and the tape 8 are accommodated in a tape cassette 80. The ink ribbon 901 is accommodated in a ribbon cassette 90. In the following description, the tape cassette 80 and ribbon cassette 90 may also be collectively referred to as "cassettes". As with the printing media, the cassettes of the present disclosure are not limited to the examples in this embodiment.

Figure 1:
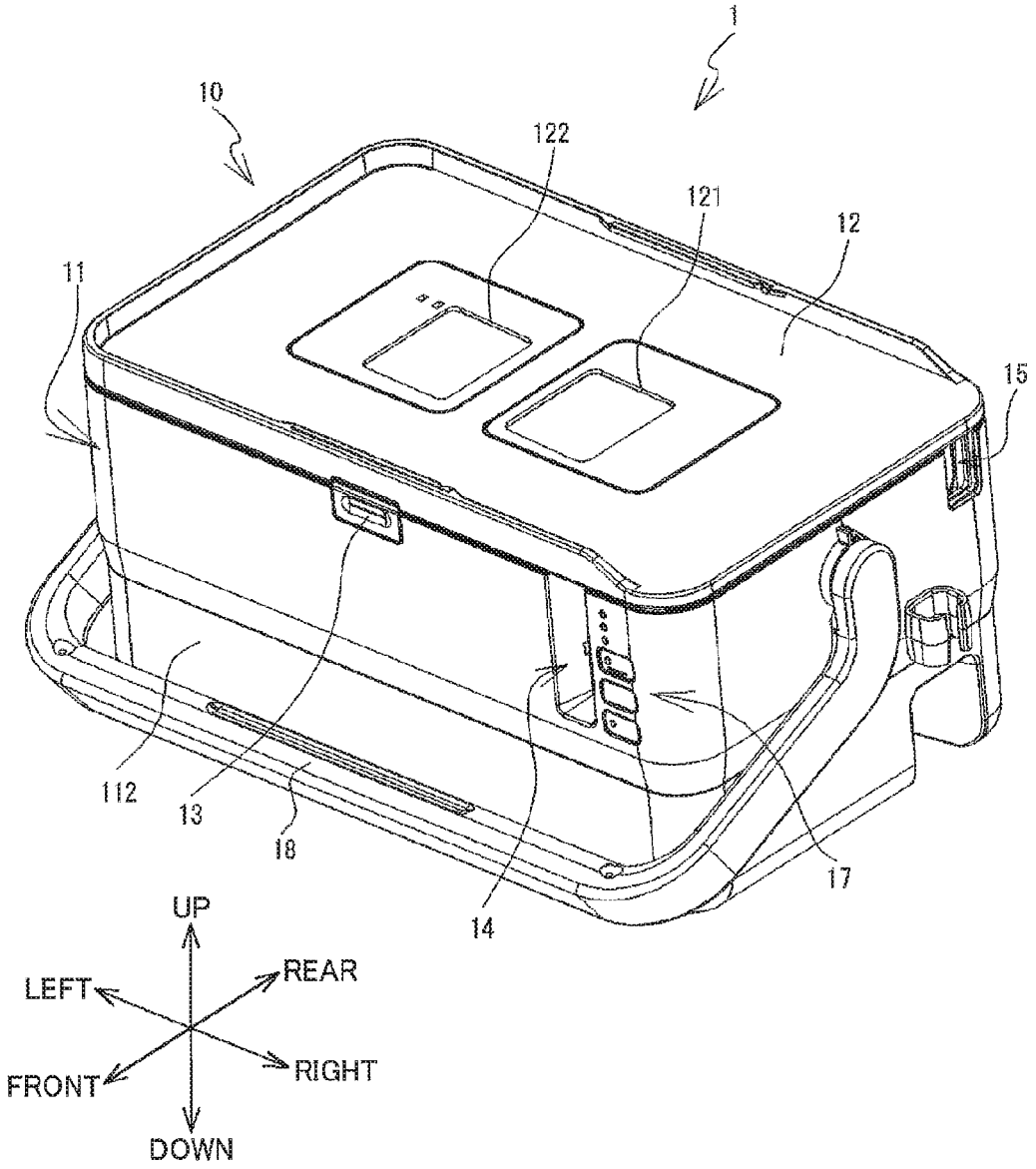
FIG. 1 is a perspective view of a printing device according to an embodiment when viewed from an upper-right and front side thereof with a body cover thereof in a closed position.
Figure 2:
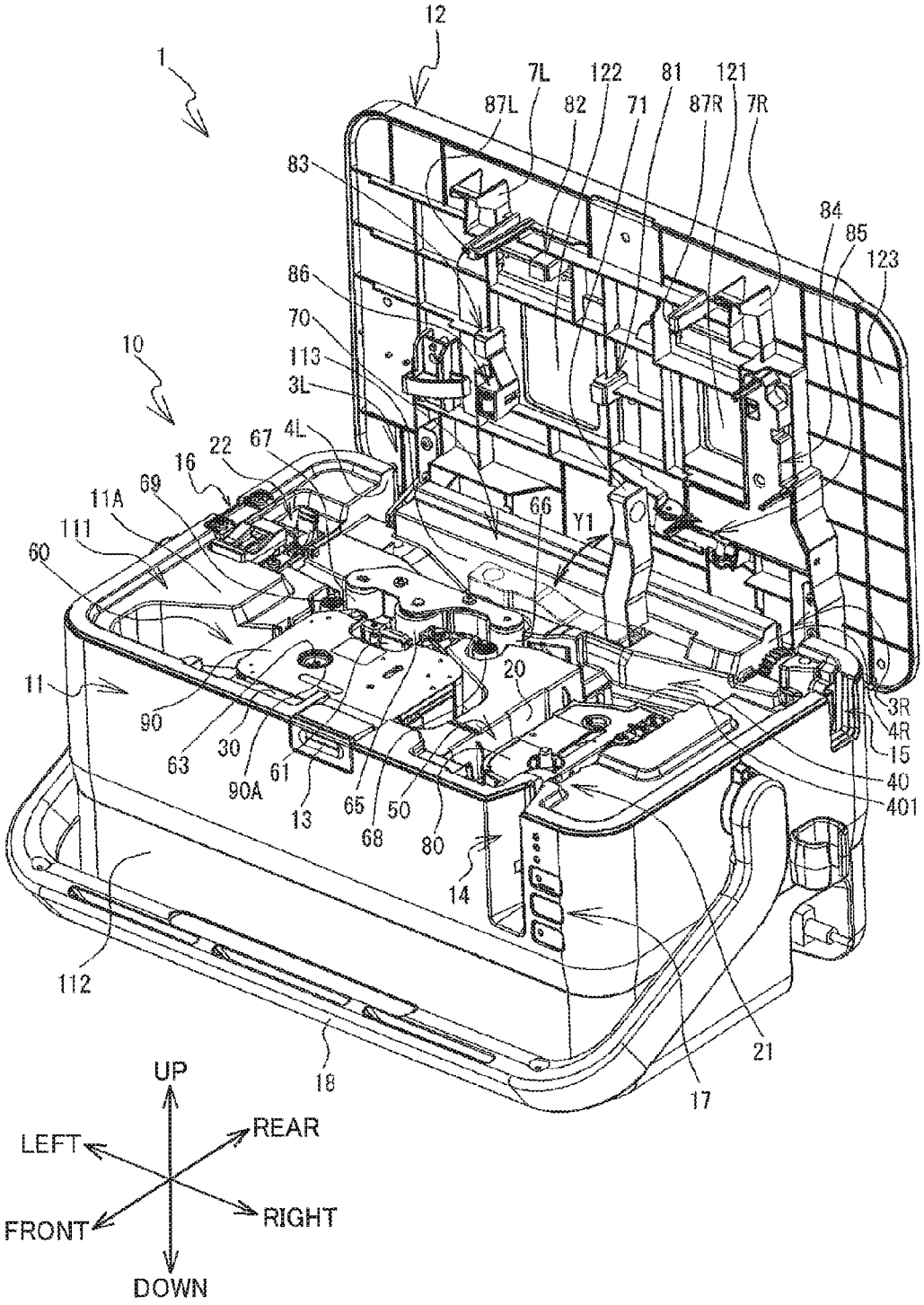
FIG. 2 is a perspective view of the printing device according to the embodiment when viewed from its upper-right and front side with the body cover thereof in an open position.

As shown in FIGS. 1 and 2, the printing device 1 includes a housing 10. The housing 10 includes a housing body 11 and a body cover 12.

The housing body 11 has a rectangular parallelepiped shape that is elongated in a left-right direction. The housing body 11 includes a case part 112, and an attachment cover 111 (see FIG. 2). The case part 112 has a box shape and is open on its top. The attachment cover 111 has a plate shape and is configured to cover an opening in the case part 112 from above.

The body cover 12 has a plate-like shape that is elongated in the left-right direction. The body cover 12 is disposed upward of the housing body 11. The body cover 12 is supported by the housing body 11 such that the body cover 12 can pivot about a rear edge thereof relative to the housing body 11. By being pivotally moved relative to the housing body 11, the body cover 12 is movable between a closed position (see FIG. 1) and an open position (see FIG. 2). When in the closed position, the body cover 12 covers an entirety of an attachment surface 11A (upper surface) of the attachment cover 111 (see FIG. 2) from above. When the body cover 12 is in the open position, the attachment surface 11A is exposed above. The attachment surface 11A constitutes a top surface of the attachment cover 111. The following description will assume that the body cover 12 is in the closed position.

A pair of hinge units 3L and 3R (see FIG. 2) is provided on the housing 10. The hinge unit 3L is disposed on a rear edge of the housing 10 near a left side thereof, while the hinge unit 3R is disposed on the rear edge of the housing 10 near a right side thereof. The hinge units 3L and 3R respectively include first recessed parts 4L and 4R and first extension parts 5L and 5R (see FIG. 5).

Specifically, the first recessed parts 4L and 4R are provided in the housing body 11, while the first extension parts 5L and 5R are provided on the body cover 12. The first recessed part 4L is recessed downward in a rear edge of the housing body 11 near a left end thereof, and the first recessed part 4R is recessed downward in the rear edge of the housing body 11 near a right end thereof. The first extension part 5L extends downward from a rear edge of the body cover 12 near a left end thereof, and the first extension part 5R extends downward from the rear edge of the body cover 12 near a right end thereof.

The first extension parts 5L and 5R engage in the first recessed parts 4L and 4R, respectively. Through this engagement, the first extension parts 5L and 5R are rotatably supported by the first recessed parts 4L and 4R, respectively. The first extension parts 5L and 5R are retained while engaged in the first recessed parts 4L and 4R, respectively. In this way, the body cover 12 is pivotably supported through the hinge units 3L and 3R. The body cover 12 defines a pivot axis that is aligned in the left-right direction.

The housing body 11 has an upper-front edge portion in which a locking mechanism 13 and second recessed parts 6L and 6R (see FIG. 3) are provided. The locking mechanism 13 is disposed at a left-right center of the upper-front edge portion of the housing body 11. The locking mechanism 13 is configured to anchor a front edge portion of the body cover 12 when the body cover 12 is in the closed position. The second recessed part 6L is disposed between a left end of the housing body 11 and the locking mechanism 13, while the second recessed part 6R is disposed between a right end of the housing body 11 and the locking mechanism 13. The second recessed parts 6L and 6R are recessed downward from the attachment surface 11A. The second recessed parts 6L and 6R can respectively engage with second extension parts 7L and 7R (see FIG. 2) of the body cover 12.

Each of the second extension parts 7L and 7R is a U-shaped hook in a front-side view. The second extension part 7L is disposed on the front edge portion of the body cover 12 at a left-right position aligned with that of the second recessed part 6L. Likewise, the second extension part 7R is disposed on the front edge portion of the body cover 12 at a left-right position aligned with that of the second recessed part 6R. The second extension parts 7L and 7R engage in the second recessed parts 6L and 6R when the body cover 12 is placed in the closed position. In this state, the second extension parts 7L and 7R can anchor the front edge portion of the body cover 12 in the closed position and restrict the body cover 12 from opening. To open the body cover 12, the user operates the locking mechanism 13 to release the body cover 12 from its anchored state. Next, the user pivotally moves the body cover 12 upward from the locking mechanism 13. Through this operation, the second extension parts 7L and 7R disengage from the second recessed parts 6L and 6R, respectively, and the body cover 12 is displaced to the open position.

Disposed on side surfaces of the housing body 11 are an operating unit 17, a tape discharge hole 14, a tubing insertion hole 15, a tubing discharge hole 16 (see FIG. 2), and a handle 18. The operating unit 17 includes a power button and a start button. The operating unit 17 is provided in an upper-right region on a front surface of the housing body 11.

The tape discharge hole 14 is an opening through which the tape 8 is configured to be discharged from the housing 10. The tape discharge hole 14 is formed in the front surface of the housing 10 (housing body 11) at an upper-right region thereof. The tape discharge hole 14 has a rectangular shape and is elongated vertically.

The tubing insertion hole 15 is an opening for guiding the tubing 9 into the housing 10. The tubing insertion hole 15 is formed in a right surface of the housing body 11 near an upper-rear corner thereof. The tubing insertion hole 15 has a rectangular shape that is elongated vertically. The tubing discharge hole 16 is an opening for discharging the tubing 9 from the housing 10. The tubing discharge hole 16 is formed in a left surface of the housing body 11 near an upper-rear corner thereof. The tubing discharge hole 16 is positioned slightly forward relative to the tubing insertion hole 15. The tubing discharge hole 16 has a rectangular shape that is elongated vertically.

The handle 18 is a member that the user can grip when carrying the printing device 1. The handle 18 spans over the top of the housing body 11 from the left surface to the right surface of the housing 10. The handle 18 is also pivotable to the front and rear sides of the housing 10.

Next, a detailed structure of the housing body 11 will be described with reference to FIGS. 2 through 4.

As shown in FIGS. 2 and 3, the attachment surface 11A includes a tape-printing unit 50, a tape-cutting unit 21, a tube-attachment unit 40, a tube-printing unit 60, a tube-cutting unit 22, and the like.

The tape-printing unit 50 is disposed in a right section of the housing body 11. The tape-printing unit 50 is configured to print characters on the tape 8. The tape-printing unit 50 includes a tape-attachment section 20, a print head 51 (see FIG. 3), a tape drive shaft 55 (see FIG. 3), and a conveying motor 23 (see FIG. 15).

The tape-attachment section 20 is a recess that is open upward. The tape-attachment section 20 has a shape (open shape) that conforms to a shape of the tape cassette 80 in a plan view. The tape-attachment section 20 is disposed in a rightward portion of the attachment surface 11A and frontward of the tube-attachment unit 40 described later. The tape cassette 80 is detachably mountable in the tape-attachment section 20. The tape cassette 80 has a box-shape that is rectangular in a plan view. The tape cassette 80 can accommodate the tape 8 and the ink ribbon 801 (see FIG. 3). The tape cassette 80 is a cassette accommodating a laminated tape, for example.

The print head 51 and tape drive shaft 55 are disposed upright on a bottom surface of the tape-attachment section 20. The print head 51 is disposed in a rightward portion of the tape-attachment section 20. The print head 51 is a thermal head provided with a heating element (not shown). The print head 51 is configured to perform printing on the 8 tape through the ink ribbon 801. The tape drive shaft 55 is disposed in a right-front portion of the tape-attachment section 20. The tape drive shaft 55 is rotatable in a clockwise direction in a plan view. The conveying motor 23 is connected to the tape drive shaft 55. The conveying motor 23 is configured to drive the tape drive shaft 55 to rotate. The conveying motor 23 is provided inside the housing body 11. The tape drive shaft 55 is inserted into the tape cassette 80 when the tape cassette 80 is received in the tape-attachment section 20. When the conveying motor 23 is driven in this condition, the tape drive shaft 55 can rotate for conveying the tape 8.

The tape-cutting unit 21 is configured to cut the tape 8 after the tape 8 has been printed. The tape-cutting unit 21 includes a cutter (not shown), and a cutting motor 24 (see FIG. 15), and the like. The tape-cutting unit 21 is configured to cut the tape 8 using the cutter. The cutter of the tape-cutting unit 21 is disposed near the tape discharge hole 14. The cutting motor 24 is configured to drive the cutter of the tape-cutting unit 21. The cutting motor 24 is disposed inside the housing body 11. Tape 8 that has been cut by the tape-cutting unit 21 is configured to be discharged from the housing 10 through the tape discharge hole 14.

The tube-attachment unit 40 is a recess that is open upward. The tubing 9 is detachably mountable in the tube-attachment unit 40. The tubing discharge hole 16 is formed at a location slightly forward of the tubing insertion hole 15. Therefore, the tube-attachment unit 40 extends substantially in the left-right direction from the tubing insertion hole 15 to the tubing discharge hole 16 while sloping toward the front. The direction in which the tube-attachment unit 40 extends from the tubing insertion hole 15 to the tubing discharge hole 16 will be called a "conveying direction". The conveying direction is orthogonal to a vertical direction. A direction orthogonal to the conveying direction and the vertical direction will be called a "specific direction".

The tube-attachment unit 40 includes an expanded part 402, a first restricting part 403, and a second restricting part 404. The expanded part 402 is provided at a position near an upstream side of a conveying roller 66 (described later) in the conveying direction. The first restricting part 403 and second restricting part 404 are parts of the tube-attachment unit 40 disposed respectively on the upstream and downstream sides of the expanded part 402 in the conveying direction. The expanded part 402 has a dimension in the specific direction that is greater than dimensions of the first restricting part 403 and second restricting part 404 in the specific direction. The dimension of the first restricting part 403 in the specific direction is substantially equal to the dimension of the second restricting part 404 in the specific direction. The tube-attachment unit 40 has a dimension in the specific direction that is greater than an outer diameter of the tubing 9 having the largest diameter that can be printed by the printing device 1. The distance from a bottom surface 401 of the tube-attachment unit 40 to a top edge of the same is greater than the outer diameter of the tubing 9. The user can mount the tubing 9 in the tube-attachment unit 40 such that the tubing 9 extends from the tubing insertion hole 15 to the tubing discharge hole 16.

The tube-printing unit 60 is disposed in a leftward portion of the housing body 11. The tube-printing unit 60 is configured to print characters on the tubing 9. The tube-printing unit 60 is provided with a ribbon-mounting section 30, a print head 61, a ribbon take-up shaft 63, conveying rollers 65-69, a conveying motor 25 (see FIG. 15), a print head motor 27 (see FIG. 15), a bending unit 100, and the like.

The ribbon-mounting section 30 is a recess that is open upward. The ribbon-mounting section 30 has an opening that is shaped to correspond to the ribbon cassette 90 in a plan view. The ribbon-mounting section 30 is formed in a left section of the attachment surface 11A and on the front side of the tube-attachment unit 40. The ribbon-mounting section 30 and the tube-attachment unit 40 are in communication with each other at the rear side of the ribbon-mounting section 30 where the two intersect. The ribbon cassette 90 is detachably mounted in the ribbon-mounting section 30. The ribbon cassette 90 is a box-shaped member that is rectangular in a plan view and capable of accommodating the ink ribbon 901.

The print head 61 and ribbon take-up shaft 63 are arranged upright on a bottom surface of the ribbon-mounting section 30. The print head 61 is disposed in a rear portion of the ribbon-mounting section 30. The print head 61 is a thermal head that is provided with a heating element (not shown). The print head 61 is configured to perform printing on the tubing 9 through the ink ribbon 901. When the ribbon cassette 90 is mounted in the ribbon-mounting section 30, the ribbon take-up shaft 63 is inserted into a ribbon take-up spool 90A provided in the ribbon cassette 90 described later. The ribbon take-up shaft 63 functions to rotate the ribbon take-up spool 90A.

The conveying rollers 65-69 are configured to convey the tubing 9 mounted in the tube-attachment unit 40 in the conveying direction. The conveying roller 65 is disposed at a position confronting the print head 61 such that the tubing 9 mounted in the tube-attachment unit 40 is interposed between the conveying roller 65 and the print head 61. The conveying roller 66 is disposed rearward of the tube-attachment unit 40 and upstream relative to the conveying roller 65 in the conveying direction. The conveying roller 67 is disposed rearward of the tube-attachment unit 40 and downstream relative to the conveying roller 65 in the conveying direction. Each of the conveying rollers 65-67 is arranged upright on the bottom surface of the ribbon-mounting section 30 and is rotatable in the clockwise direction in a plan view.

The conveying roller 68 is disposed at a position confronting the conveying roller 66 with the tubing 9 mounted in the tube-attachment unit 40 interposed between the conveying rollers 68 and 66. The conveying roller 69 is disposed at a position confronting the conveying roller 67 with the tubing 9 mounted in the tube-attachment unit 40 interposed between the conveying rollers 67 and 69. Thus, of the conveying rollers 65-69, the conveying rollers 66 and 68 are disposed farthest upstream in the conveying direction, while the conveying rollers 67 and 69 are disposed farthest downstream in the conveying direction. The conveying rollers 68 and 69 are arranged upright from the bottom surface of the ribbon-mounting section 30 and are rotatable in a counterclockwise direction in a plan view. The conveying motor 25 is connected to the conveying rollers 65-69 and the ribbon take-up shaft 63. The conveying motor 25 can drive the conveying rollers 65-69 and the ribbon take-up shaft 63 to rotate. The conveying motor 25 is disposed inside the housing body 11.

The conveying rollers 68 and 69 are each displaceable between a printing position and a non-printing position. In FIG. 3, the conveying rollers 68 and 69 are depicted with solid lines to indicate their printing positions and are depicted with two-dot chain lines to indicate their non-printing positions. In the printing positions, the conveying rollers 68 and 69 are respectively adjacent to the conveying rollers 66 and 67 with the tubing 9 interposed therebetween. In the non-printing positions, the conveying rollers 68 and 69 are respectively separated from the conveying rollers 66 and 67. The conveying rollers 68 and 69 are positioned farther frontward in their non-printing positions than in their printing positions. The user can displace the conveying rollers 68 and 69 between the printing positions and non-printing positions by operating a release lever 71 of a release mechanism 70. The release mechanism 70 will be described later in greater detail.

The print head motor 27 is connected to the print head 61. The print head motor 27 is configured to drive the print head 61. The print head motor 27 is disposed inside the housing body 11. When the print head motor 27 is driven, the print head 61 is displaced between its printing position and non-printing position. In FIG. 3, the printing position of the print head 61 is depicted with solid lines, while the non-printing position of the print head 61 is depicted with two-dot chain lines. When in its printing position, the print head 61 pinches the tubing 9 against the conveying roller 65. When in its non-printing position, the print head 61 is separated from the conveying roller 65. The print head 61 is disposed farther forward than the tube-attachment unit 40 when in the non-printing position.

When the ribbon cassette 90 is mounted in the ribbon-mounting section 30 while the print head 61 is in the non-printing position, the ribbon take-up shaft 63 becomes inserted into the ribbon take-up spool 90A of the ribbon cassette 90. Subsequently, the print head 61 is displaced to the printing position as the print head motor 27 is driven. The print head 61 urges the unused ink ribbon 901 and the tubing 9 mounted in the tube-attachment unit 40 against the conveying roller 65 so that the ink ribbon 901 and tubing 9 are overlapped. At this time, the urged tubing 9 is elastically deformed into a flat state. The flattened tubing 9 establishes surface contact with the print head 61 through the ink ribbon 901. When the conveying motor 25 is driven in this state, the conveying rollers 65-69 and the ribbon take-up shaft 63 rotate, thereby conveying the tubing 9 and taking up the used ink ribbon 901.

Figure 4:
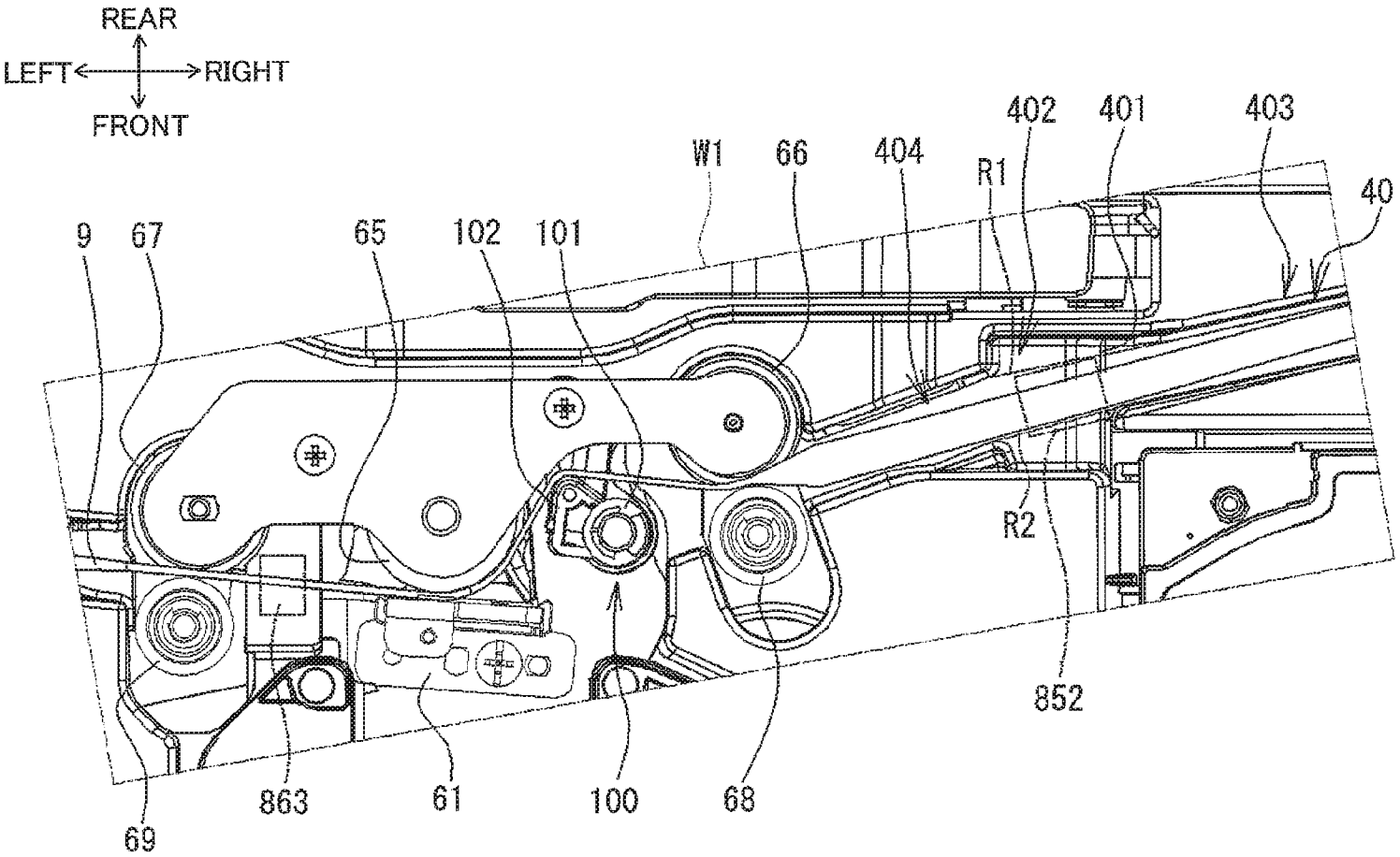
FIG. 4 is an enlarged view of a region WI shown in FIG. 3.

As shown in FIG. 4, the bending unit 100 serves to bend the tubing 9. The bending unit 100 includes a support part 101, and a contact part 102. The support part 101 is a round bar that extends vertically upward from the bottom surface of the ribbon-mounting section 30. The support part 101 is fixed between the conveying roller 65 and the conveying rollers 66 and 68 in the conveying direction. The contact part 102 protrudes obliquely upward and leftward from a left portion on the circumferential surface of the support part 101. The contact part 102 is generally rectangular in a plan view. The tubing 9 conveyed from the right side of the bending unit 100 (the upstream side in the conveying direction) contacts a left-rear edge of the contact part 102. A front portion of the conveying roller 65 is positioned farther forward than the bending unit 100. Therefore, after contacting the left-rear edge of the contact part 102, the tubing 9 that has come from the right is bent and conveyed forward. Therefore, the bending unit 100 can apply suitable back tension to the tubing 9. Further, the surface area of the tubing 9 contacting the conveying roller 65 is greater than that if the tubing 9 were conveyed toward the conveying roller 65 from the right side thereof, thereby stabilizing conveyance of the tubing 9. When bent by the bending unit 100, the tubing 9 is elastically deformed into a flattened state. In this state, the tubing 9 is conveyed more stably than when the tubing 9 is conveyed by being pinched between the conveying roller 65 and print head 61 while not in an elastically deformed state. This arrangement can suppress generation of wrinkles and the like in the tubing 9 and other conveyance problems.

As shown in FIG. 3, the tube-cutting unit 22 is provided for cutting the tubing 9 after the tubing 9 has been printed. The tube-cutting unit 22 includes a cutter 22A, a cutting base 22B, a cutter motor 26 (see FIG. 15), and the like. The cutter 22A is configured to cut the tubing 9. The cutter 22A is disposed near the tubing discharge hole 16. The cutting base 22B is disposed at a position opposing the cutter 22A. The portion of the tubing 9 to be cut is positioned on the cutting base 22B. The cutter motor 26 is configured to drive the cutter 22A. The cutter motor 26 is disposed inside the housing body 11. The portion of the tape 8 cut by the tube-cutting unit 22 is configured to be discharged from the housing 10 through the tubing discharge hole 16.

A first sensor 45L and a second sensor 45R (see FIG. 15) are also provided inside the housing body 11. The first sensor 45L and second sensor 45R are configured to detect whether the body cover 12 is in the open position or in the closed position. The first sensor 45L and second sensor 45R are both switch sensors (or contact sensors).

Specifically, the first sensor 45L and second sensor 45R respectively includes a first contact part 46L and a second contact part 46R. The first contact part 46L is disposed near a right-rear portion of the second recessed part 6L, and the second contact part 46R is disposed near a left-rear portion of the second recessed part 6R. The first contact part 46L and second contact part 46R can respectively contact a first protruding part 87L and a second protruding part 87R (described later; see FIG. 5) provided on the body cover 12. The first contact part 46L and second contact part 46R are provided to protrude upward from the attachment surface 11A. Specifically, the first contact part 46L and second contact part 46R are configured to advance and retract relative to the attachment surface 11A. When the first contact part 46L and second contact part 46R are pressed downward respectively, respective the first sensor 45L and second sensor 45R are configured to output an ON signal. When the first contact part 46L and second contact part 46R are not pressed downward, the respective first sensor 45L and second sensor 45R are respectively configured to output an OFF signal.

Next, a detailed structure of the body cover 12 will be described with reference to FIGS. 4 through 8. In the following description, the lower-right, upper-left, lower-left, upper-right, upper, and lower sides (directions) in FIG. 5 correspond to the left, right, front, rear, top, and bottom of the body cover 12.

Figure 5:
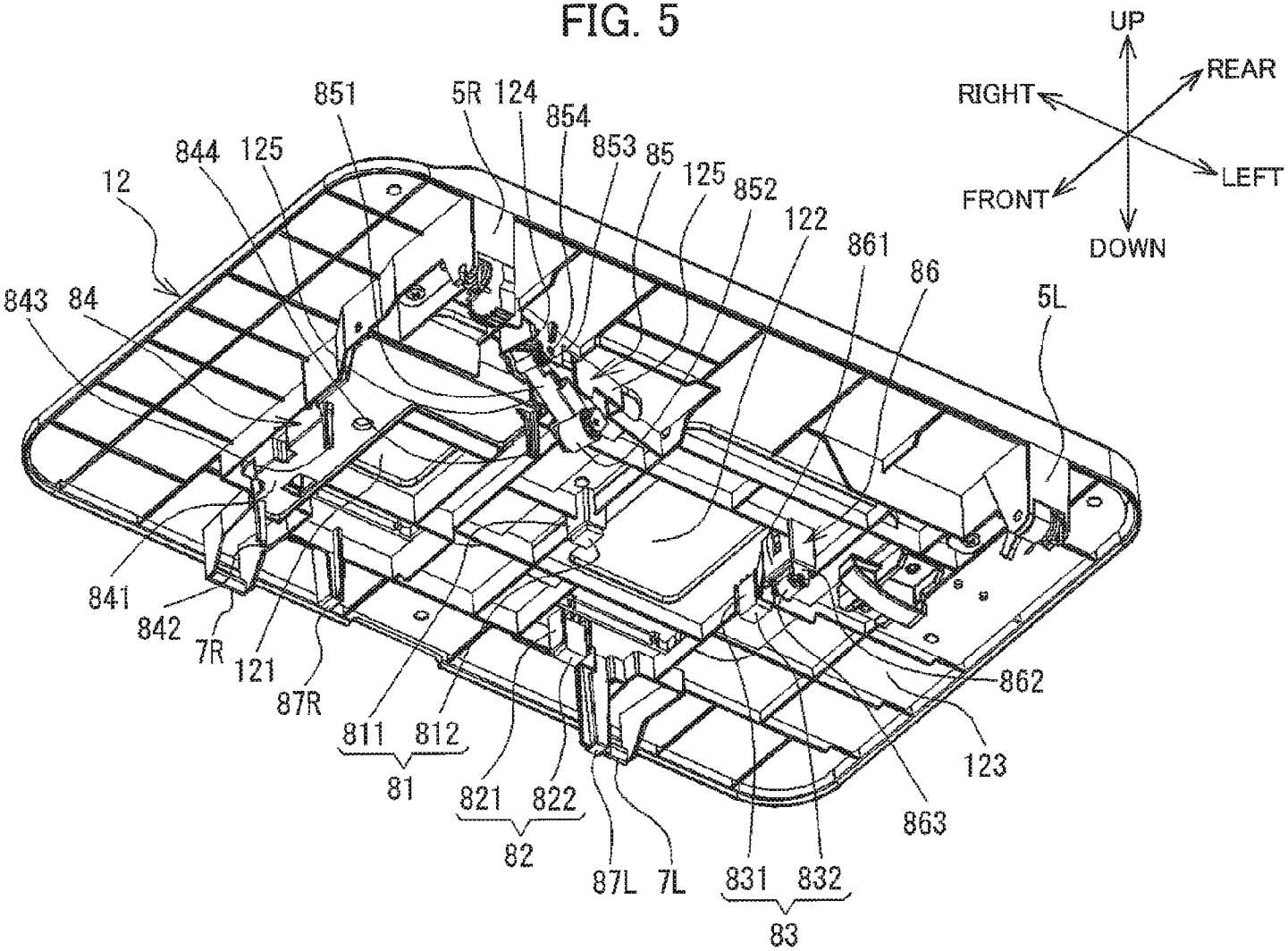
FIG. 5 is a perspective view of the body cover when viewed from a lower-right and rear side thereof.
Figure 6:
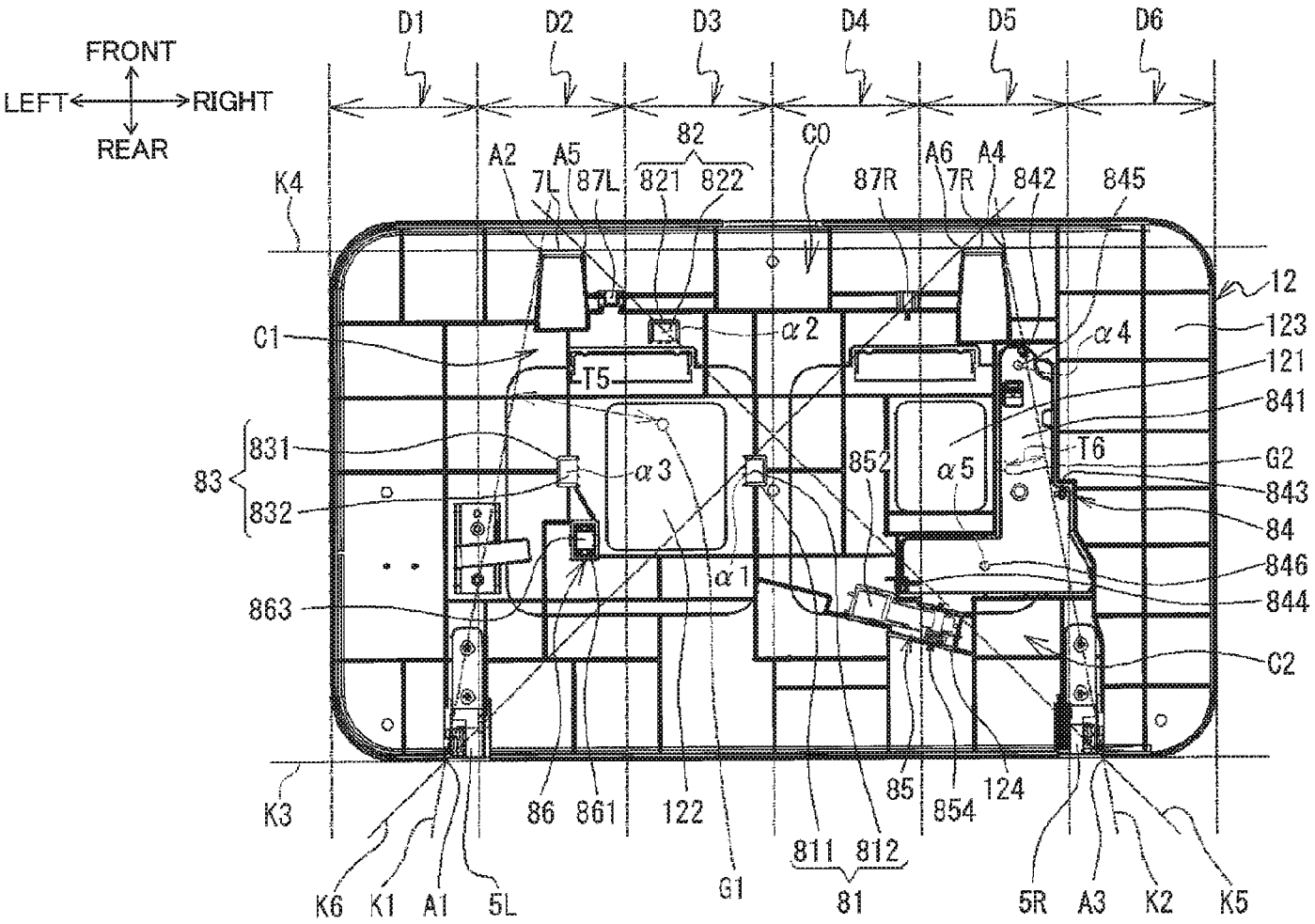
FIG. 6 is a bottom view of the body cover.

As shown in FIGS. 5 and 6, the body cover 12 is provided with windows 121 and 122. The windows 121 and 122 have a rectangular shape in a plan view. The window 121 is disposed in a right section of the body cover 12 at a position that corresponds to the tape-attachment section 20 when the body cover 12 is in the closed position. Accordingly, the user can confirm that the tape cassette 80 is mounted in the tape-attachment section 20 through the window 121. The window 122 is disposed in a left section of the body cover 12 at a position that corresponds to the ribbon-mounting section 30 when the body cover 12 is in the closed position. Accordingly, the user can confirm that the ribbon cassette 90 is mounted in the ribbon-mounting section 30 through the window 122.

The body cover 12 has a bottom surface (hereinafter called an opposing surface 123) that opposes the attachment surface 11A when the body cover 12 is in the closed position. Disposed on the opposing surface 123 are first pressing parts 81, 82, and 83, a second pressing part 84, third pressing parts 85 and 86, a first protruding part 87L, and a second protruding part 87R.

When the body cover 12 is in the closed position, the first pressing parts 81, 82, and 83 elastically contact the ribbon cassette 90 mounted in the ribbon-mounting section 30 from above, thereby pressing the ribbon cassette 90 downward. The first pressing parts 81, 82, and 83 are provided with corresponding retaining parts 811, 821, and 831 and corresponding sponges 812, 822, and 832. The retaining parts 811, 821, and 831 are respectively disposed on the right, front, and left sides of the window 122. Each of the retaining parts 811, 821, and 831 has a box-like shape that is open downward and protrudes downward from the opposing surface 123. The sponges 812, 822, and 832 are elastic members with a rectangular parallelepiped shape. In the embodiment, the sponges 812, 822, and 832 all have the same shape and are formed of the same material. However, the printing device 1 may employ sponges 812, 822, and 832 having differing shapes and formed of differing materials and the like. The sponges 812, 822, and 832 are mounted in the corresponding retaining parts 811, 821, and 831. When mounted in the retaining parts 811, 821, and 831, the corresponding sponges 812, 822, and 832 protrude downward from respective bottom edges of the retaining parts 811, 821, and 831. Hence, when the body cover 12 is in the closed position, respective bottom ends of the sponges 812, 822, and 832 constituting the first pressing parts 81, 82, and 83 can elastically contact the ribbon cassette 90. In this state, the sponges 812, 822, and 832 are compressed by the same amount.

When the body cover 12 is in the closed position, the second pressing part 84 elastically contacts the tape cassette 80 mounted in the tape-attachment section 20 from above, thereby pressing the tape cassette 80 downward. The second pressing part 84 includes a plate part 841, protruding parts 842, 843, and 844, and helical springs 845 and 846 (see FIG. 6). The plate part 841 has an L-shape that extends in a horizontal direction along the right side and rear side of the window 121. The protruding parts 842, 843, and 844 protrude downward from a bottom surface of the plate part 841. The protruding part 842 is disposed in a right-front corner portion of the plate part 841. The protruding part 843 is disposed in an approximate front-rear center region on a right edge of the plate part 841. The protruding part 844 is disposed in a left-rear corner portion of the plate part 841. When the body cover 12 is in the closed position, respective bottom ends of the protruding parts 842, 843, and 844 contact the tape cassette 80. The helical springs 845 and 846 are provided between the plate part 841 and opposing surface 123. One end of each of the helical springs 845 and 846 is fixed to a top surface of the plate part 841, while the other end of each of the helical springs 845 and 846 is fixed to the opposing surface 123. The helical spring 845 is disposed near a rear edge of the protruding part 842. The helical spring 846 is disposed in an approximate center position of a line extending horizontally between the protruding parts 843 and 844. The helical springs 845 and 846 urge the plate part 841 downward. In the present embodiment, the helical springs 845 and 846 have the same shape and are formed of the same material. Accordingly, when the body cover 12 is in the closed position, the same magnitude of load is applied to both the helical springs 845 and 846. Note that the printing device 1 may employ helical springs 845 and 846 having differing shapes and formed of differing materials.

Figure 7:
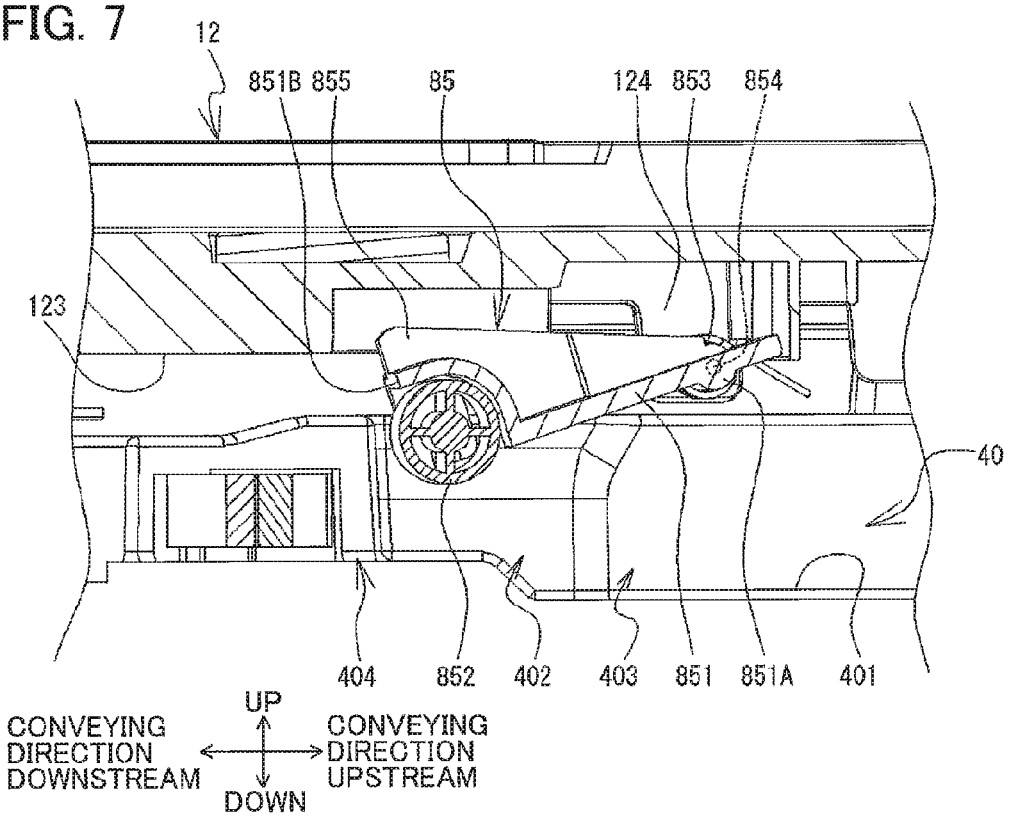
FIG. 7 is a vertical cross-sectional view of a third pressing part.
Figure 8:
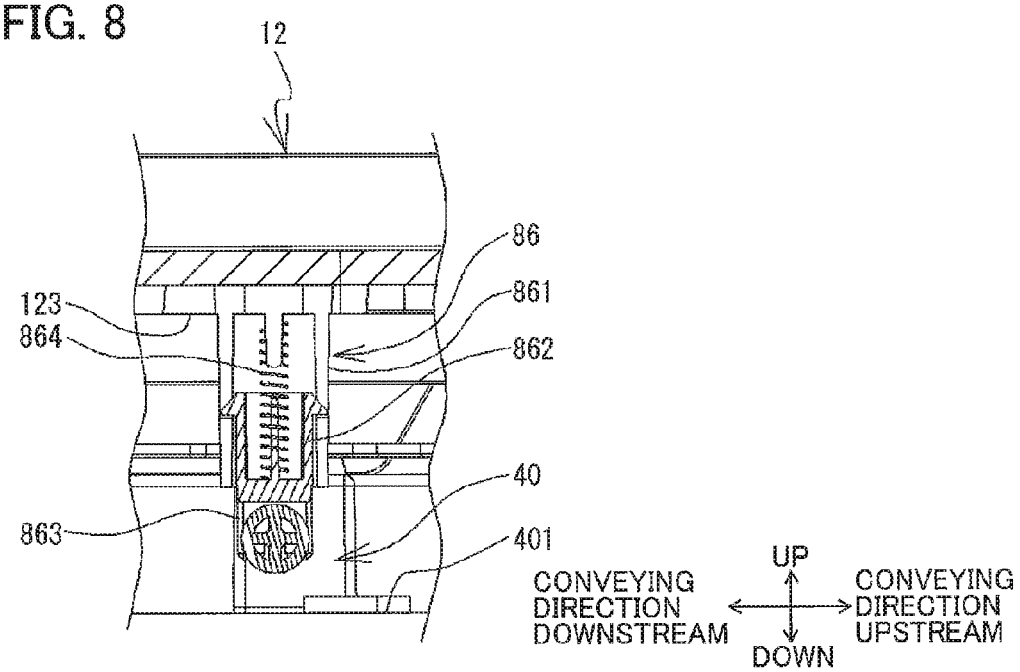
FIG. 8 is a vertical cross-sectional view of another third pressing part.

When the body cover 12 is placed in the closed position, at least portions of the third pressing parts 85 and 86 advance into the tube-attachment unit 40 (see FIGS. 7 and 8). In this state, the third pressing parts 85 and 86 press downward on the tubing 9 mounted in the tube-attachment unit 40. The third pressing parts 85 and 86 are retracted from the tube-attachment unit 40 when the body cover 12 is pivoted by a considerable amount in a direction for displacing the body cover 12 from the closed position to the open position (see FIG. 2). At this time, the third pressing parts 85 and 86 are separated from the tubing 9 mounted in the tube-attachment unit 40. It is unlikely or impossible that the third pressing parts 85 and 86 will press downward on the tubing 9 mounted in the tube-attachment unit 40 when the body cover 12 is in the open position.

As shown in FIGS. 5 and 7, the third pressing part 85 includes an arm part 851, a roller 852, and a torsion spring 853. The arm part 851 has a rectangular shape in a plan view and is elongated in the conveying direction. The arm part 851 has an upstream end 851A positioned upstream in the conveying direction, and a shaft part 854 disposed on the upstream end 851A of the arm part 851. The shaft part 854 of the arm part 851 is rotatably supported by a support wall 124 provided on the opposing surface 123. The support wall 124 extends downward from the opposing surface 123. The shaft part 854 extends to be aligned in the specific direction. With this structure, the arm part 851 is supported by the support wall 124 such that the arm part 851 is pivotally movable about the shaft part 854 (specifically, an axis of the shaft part 854).

As shown in FIG. 7, a guide part 855 is provided on the arm part 851. The guide part 855 has a plate shape and extends upward from the top of the arm part 851 between the upstream end 851A and a downstream end 851B of the arm part 851 positioned downstream in the conveying direction. As shown in FIG. 5, a pair of guide walls 125 is provided on the body cover 12. The guide walls 125 have a plate shape, protrude downward from the opposing surface 123, and extend in the conveying direction. The guide part 855 (see FIG. 7) is disposed between the guide walls 125. The arm part 851 can pivot about the shaft part 854 while the guide part 855 is guided between the guide walls 125.

As shown in FIG. 7, the roller 852 is supported on the downstream end 851B of the arm part 851 so as to be rotatable in the clockwise direction in a front view. The roller 852 advances into the expanded part 402 of the tube-attachment unit 40 when the body cover 12 is placed in the closed position. The position of the roller 852 when the body cover 12 is in the closed position is depicted in phantom in FIG. 4. The roller 852 has a dimension in the front-rear direction (a direction orthogonal to the pivot axis of the body cover 12) that is smaller than a dimension of the expanded part 402 in the front-rear direction (see FIG. 4). With this arrangement, the roller 852 does not interfere with the tube-attachment unit 40 when the body cover 12 is pivoted relative to the housing body 11. Hence, the roller 852 can advance into the expanded part 402 when the body cover 12 is placed in the closed position.

As shown in FIGS. 5 and 7, the torsion spring 853 has a coil part, and a pair of anchoring parts that extend from the coil part to the outer radial side thereof. One of the anchoring parts of the torsion spring 853 is fixed to the arm part 851, while the other anchoring part is fixed to the body cover 12. The torsion spring 853 urges the arm part 851 to pivot downward (counterclockwise in a front view). With this configuration, the roller 852 can press downward on the tubing 9 mounted in the tube-attachment unit 40 when the body cover 12 is in the closed position.

As shown in FIG. 4, front and rear side wall portions of the first restricting part 403 and second restricting part 404 are configured to restrict movement of the tubing 9 in the specific direction. Thus, the tubing 9 is conveyed through the expanded part 402 so that the tubing 9 passes between a first restriction line segment R1 and a second restriction line segment R2. The first restriction line segment R1 connects a downstream end of the rear side wall portion constituting the first restricting part 403 to an upstream end of the rear side wall portion constituting the second restricting part 404 in the conveying direction. The second restriction line segment R2 connects a downstream end of the front side wall portion constituting the first restricting part 403 to an upstream end of the front side wall portion constituting the second restricting part 404 in the conveying direction. The dimension of the roller 852 in the specific direction is substantially equivalent to the shortest distance between the first restriction line segment R1 and second restriction line segment R2 in the specific direction (hereinafter called a "specific distance").

If the dimension of the roller 852 in the specific direction were smaller than the specific distance, then a gap in the specific direction would be formed between the roller 852 and at least one of the first restriction line segment R1 and second restriction line segment R2. Consequently, there is potential for the tubing 9 to enter this gap when the tubing 9 has a small outer diameter. In such a case, the roller 852 may not contact the tubing 9 properly. In the present embodiment, the tube-attachment unit 40 is provided with the expanded part 402. Accordingly, the dimension of the roller 852 in the specific direction can be set greater in the printing device 1 of the present embodiment than in a printing device not provided with the expanded part 402. This construction of the present embodiment can reduce or eliminate gaps formed between the roller 852 and the first restriction line segment R1 and second restriction line segment R2. Thus, the third pressing part 85 of the embodiment can increase the range over which the third pressing part 85 (roller 852) can adequately press against the tubing 9 mounted in the tube-attachment unit 40 than a structure in which the dimension of the third pressing part 85 (roller 852) in the specific direction is small. Here, the roller 852 preferably has a dimension in the specific direction at least equal to the specific distance in order to reduce gaps formed between the roller 852 and the first restriction line segment R1 and second restriction line segment R2 so that the roller 852 can adequately press down on the tubing 9 mounted in the tube-attachment unit 40.

As shown in FIGS. 5 and 8, the third pressing part 86 includes a support part 861, a moving part 862, a roller 863, and a helical spring 864 (see FIG. 8). The support part 861 is provided on the opposing surface 123. The support part 861 has a box shape that is open on the bottom. The moving part 862 is open on the top. The moving part 862 is inserted into the support part 861 and is capable of moving vertically therein. The moving part 862 has a bottom end that protrudes downward from the opening in the support part 861.

As shown in FIG. 8, the roller 863 is supported at the bottom end of the moving part 862 and is rotatable in a clockwise direction in the front view of FIG. 8. When the body cover 12 is in the closed position, the roller 863 advances into the tube-attachment unit 40 at a position between the print head 61 and conveying roller 67 in the conveying direction. The position of the roller 863 when the body cover 12 is in the closed position is depicted in phantom in FIG. 4.

The helical spring 864 is disposed inside the support part 861. One end of the helical spring 864 is fixed to a bottom surface of the support part 861 (upper surface in FIG. 8), while the other end is fixed to a bottom surface of the moving part 862 (bottom surface in FIG. 8). The helical spring 864 thus urges the moving part 862 downward. Accordingly, the roller 863 can press downward on the tubing 9 mounted in the tube-attachment unit 40 when the body cover 12 is in the closed position.

As shown in FIGS. 5 and 6, the first protruding part 87L and second protruding part 87R protrude downward from the opposing surface 123. The first protruding part 87L is provided near a right-rear end of the second extension part 7L, and the second protruding part 87R is provided near a left-rear end of the second extension part 7R. When the body cover 12 is in the closed position (see FIG. 1), the first protruding part 87L and second protruding part 87R press down on the first contact part 46L and second contact part 46R, respectively. When the body cover 12 is in the open position (see FIG. 2), at least one of the first protruding part 87L and second protruding part 87R is separated from the first contact part 46L and second contact part 46R.

Next, a structure of a release mechanism 70 will be described in detail with reference to FIGS. 9 through 13.

As explained earlier, the release mechanism 70 is a mechanism that enables the conveying rollers 68 and 69 to move between the printing positions and non-printing positions. The release mechanism 70 is provided in the housing body 11 (see FIGS. 2 and 3). The release mechanism 70 is supported by a frame 91 that is provided below the attachment surface 11A (see FIG. 9, for example).

Specifically, as shown in FIGS. 9 through 13, the release mechanism 70 includes the release lever 71, linking members 72 and 73, a release rod 74, and arm parts 75 and 76. The release lever 71 is mounted in a recessed part 113 formed in the attachment cover 111 (see FIG. 2). The recessed part 113 is formed rearward of the tube-attachment unit 40. The recessed part 113 is recessed downward and elongated in the left-right direction. In the release mechanism 70, by toggling the release lever 71 between a horizontal position (see FIGS. 9 to 11) and a vertical position (see FIGS. 12 and 13), the arm parts 75 and 76 can be switched between a first position (see FIGS. 9 and 11) and a second position (see FIG. 13), respectively. When the arm parts 75 and 76 are in the first position, the conveying rollers 68 and 69 are in an operating position (see FIGS. 9 and 11). In the operating position, the conveying rollers 68 and 69 respectively contact the conveying rollers 66 and 67 with a prescribed pressure. When the arm parts 75 and 76 are in the second position, the conveying rollers 68 and 69 are in a retracted position (see FIG. 13). In the retracted position, the conveying rollers 68 and 69 are separated from the conveying rollers 66 and 67. The structure of the release mechanism 70 in the following description will be described based on the release lever 71 being in the horizontal position.

Figure 9:
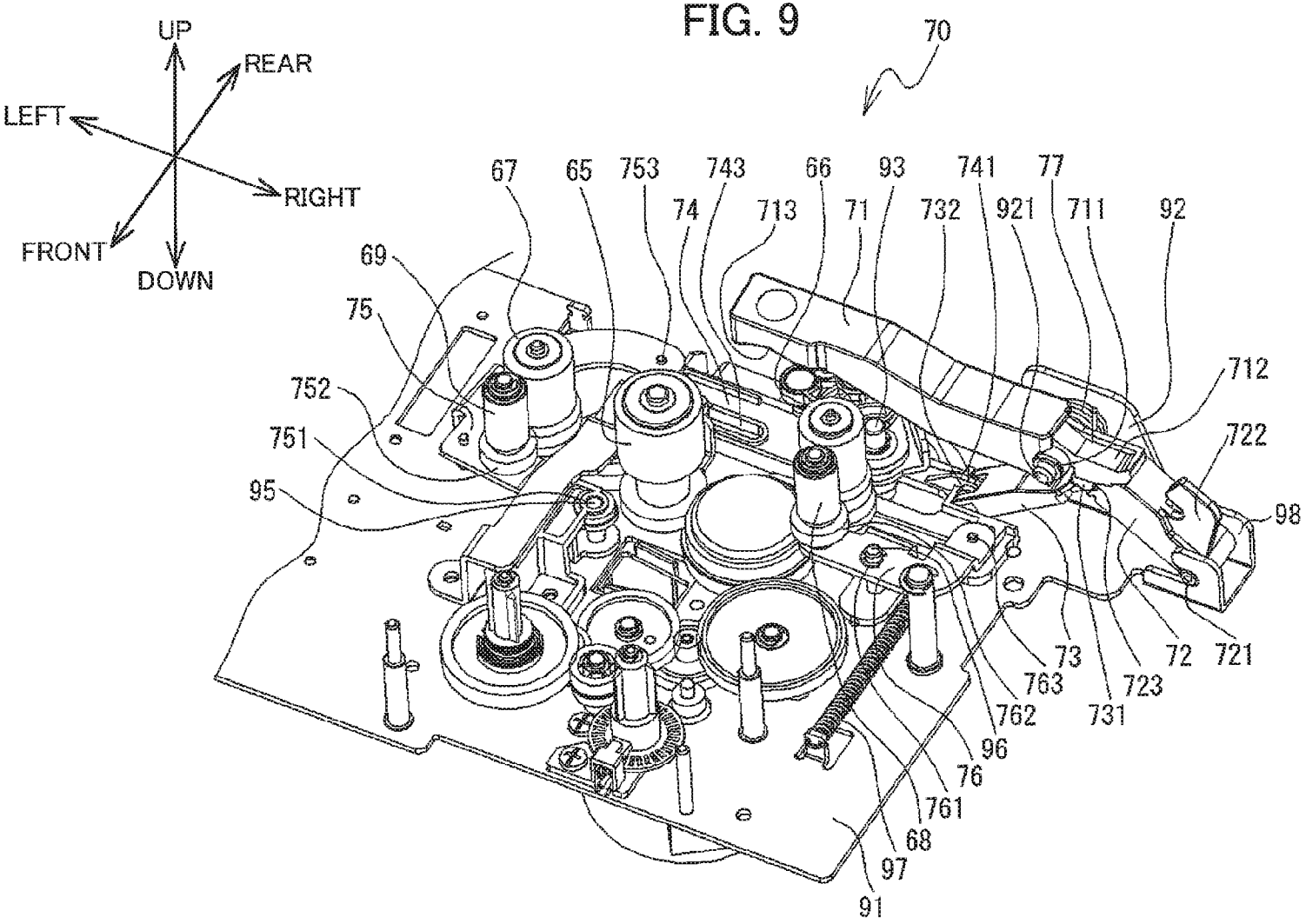
FIG. 9 is a perspective view of a release mechanism when viewed from an upper-right and front side thereof, wherein a release lever is in a horizontal position.
Figure 10:
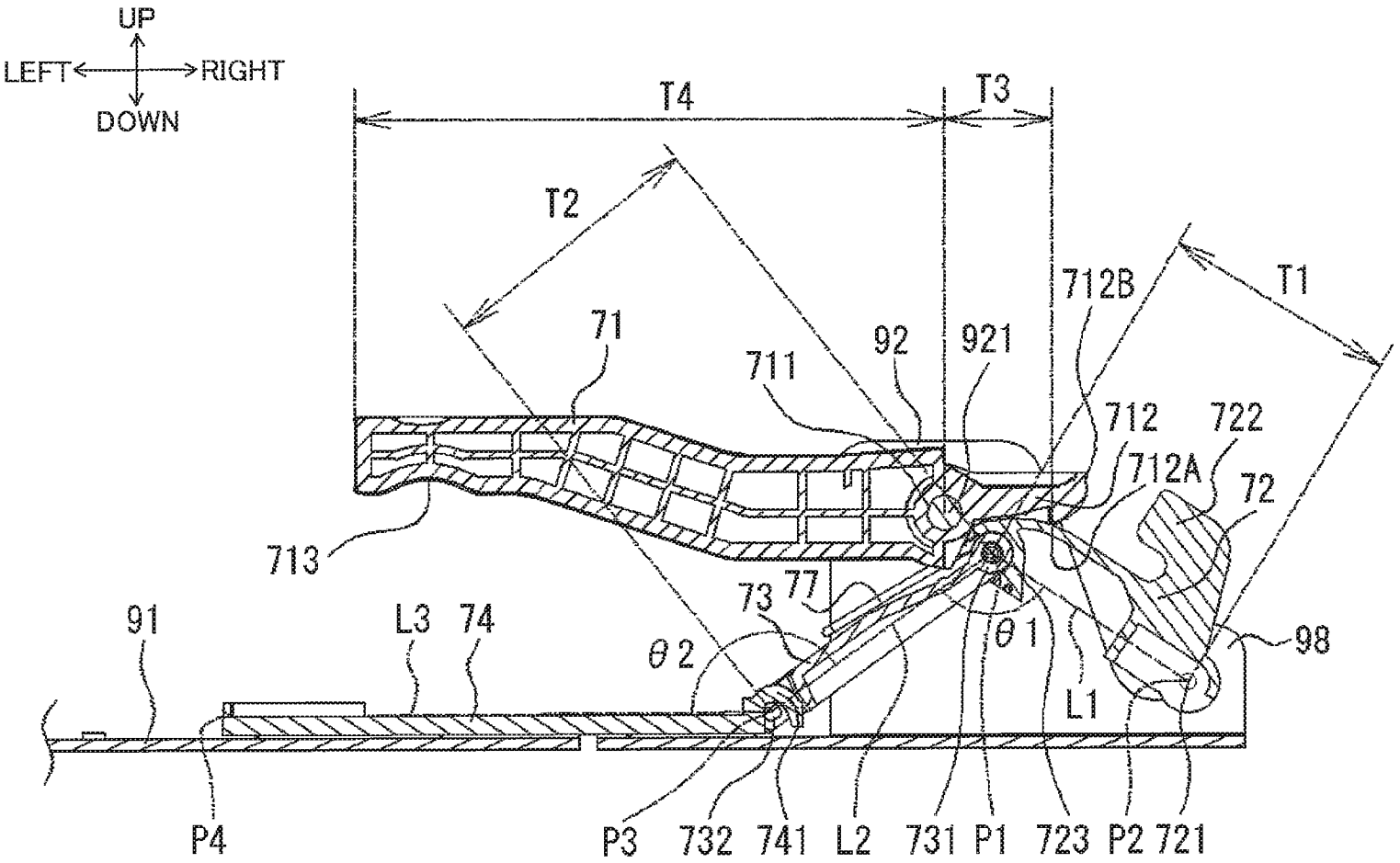
FIG. 10 is a vertical cross-sectional view of the release lever in the horizontal position.

As shown in FIGS. 9 and 10, the release lever 71 has a general rectangular parallelepiped shape and is elongated in the left-right direction. The release lever 71 includes a shaft hole 711, a tail part 712, and a recessed part 713. The shaft hole 711 is formed near a right end of the release lever 71. The shaft hole 711 is circular in a front side view and penetrates near the right end of the release lever 71 in the front-rear direction. A shaft 921 is inserted into the shaft hole 711. The shaft 921 is a circular rod extending in the front-rear direction and is supported by a support part 92 of the frame 91. Specifically, the frame 91 extends parallel to a horizontal plane and the support part 92 is formed by upwardly bending a rear edge portion of the frame 91. With this structure, the release lever 71 is supported by the shaft 921 to be pivotable in a direction indicated by an arrow Y1 in FIG. 2. The release lever 71 is urged in the clockwise direction in a front side view by a torsion spring 77. One end of the torsion spring 77 is fixed to the support part 92, while the other end is fixed to the release lever 71.

The tail part 712 is provided on the right end of the release lever 71. The tail part 712 has a general triangular shape in a front side view. A distal end 712A on a bottom surface of the tail part 712 is configured to contact a top surface of the linking member 72 on a left portion thereof. The recessed part 713 is provided on a left end of the release lever 71. The recessed part 713 is recessed upward from a bottom surface of the release lever 71 to form an arch-like shape. The user grips the recessed part 713 to operate the release lever 71.

The linking member 72 has a general rectangular parallelepiped shape and is elongated in the left-right direction. The linking member 72 includes a shaft 721, a guide part 722, and a connecting part 723. The shaft 721 extends in the front-rear direction. The shaft 721 is rotatably supported by a support part 98 constituting the frame 91. The support part 98 is formed by bending a right-rear end of the frame 91 upward. The support part 98 has a hook shape in a side view that opens upward. The guide part 722 is provided on the top surface of the linking member 72. The guide part 722 has a plate shape and extends upward. The guide part 722 has a hook shape in a front view that opens toward the left. The connecting part 723 is provided on a left end of the linking member 72. The connecting part 723 is connected to a right end (connecting part 731) of the linking member 73.

The linking member 73 has a general rectangular parallelepiped shape and is elongated in the left-right direction. The linking member 73 has connecting parts 731 and 732 (see FIG. 10). The connecting part 731 is provided on the right end of the linking member 73. The connecting part 731 is connected to the connecting part 723 of the linking member 72. The connecting part 732 is disposed on a left end of the linking member 73. The connecting part 732 is connected to a right end (connecting part 741) of the release rod 74.

Figure 13:
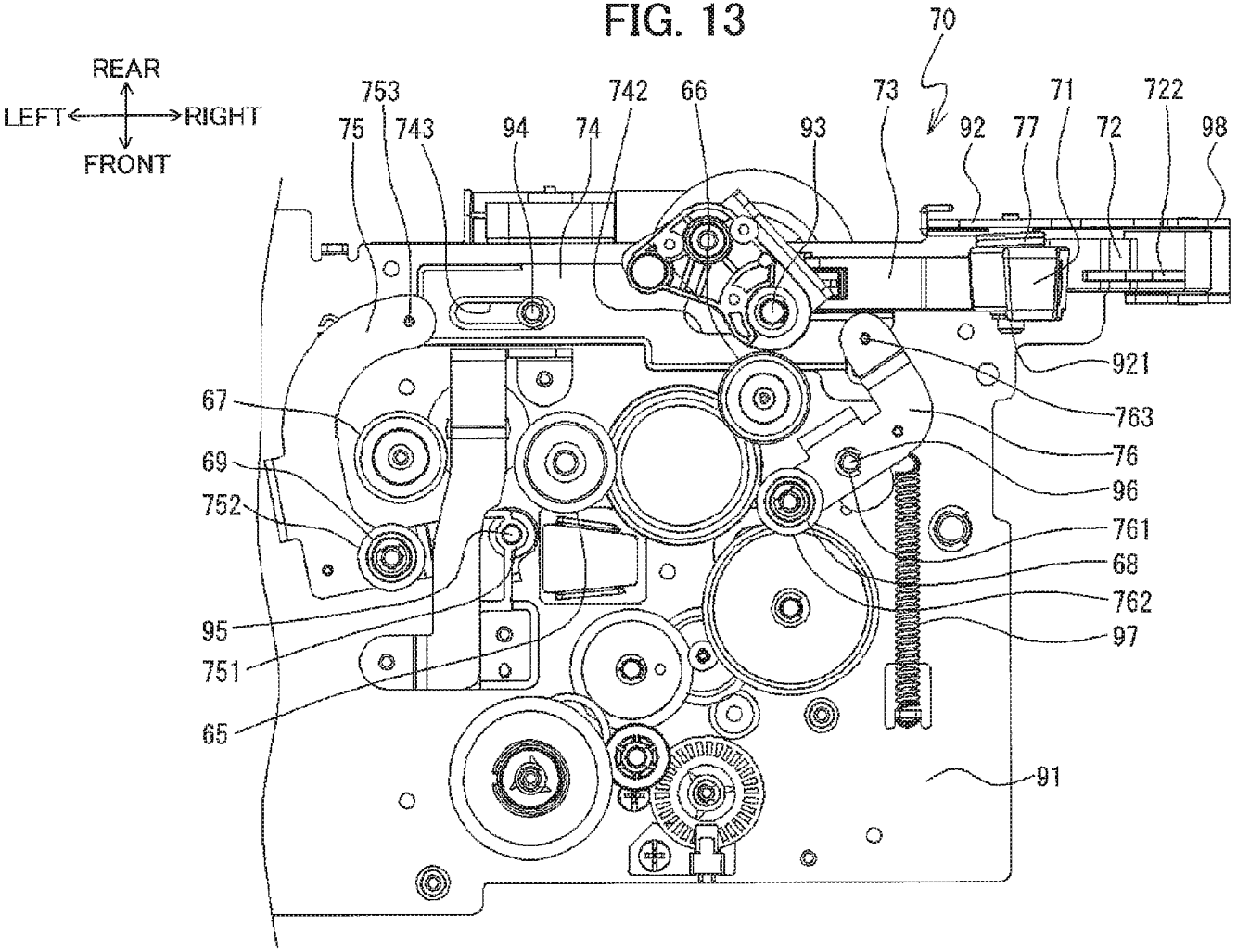
FIG. 13 is a plan view of the release mechanism, wherein the release lever is in the vertical position.

The release rod 74 is a plate-shaped member that is rectangular in a plan view and elongated in the left-right direction. The release rod 74 has a connecting part 741, and guide holes 742 and 743 (see FIG. 13). The connecting part 741 is arranged on the right end of the release rod 74. As shown in FIG. 10, the connecting part 741 is connected to the connecting part 732 of the linking member 73. The connecting part 741 has a hook shape in a front-side view that opens downward. As shown in FIG. 13, the guide holes 742 and 743 are elongated in the left-right direction and penetrate a leftward portion of the release rod 74 vertically. The guide hole 742 is formed rightward of the guide hole 743. Protruding parts 93 and 94 provided on the frame 91 are inserted into the guide holes 742 and 743, respectively. The protruding parts 93 and 94 protrude upward from the top surface of the frame 91. The protruding part 93 is disposed on the right side of the protruding part 94.

As shown in FIG. 9, the arm part 75 extends forward from a position on the left side of the release rod 74. The arm part 75 has a hook shape in a plan view that opens toward the right. The arm part 75 is supported on the frame 91 so as to be capable of pivoting between the first position and the second position. Specifically, the arm part 75 includes a shaft hole 751, a support part 752, and a contact part 753. The shaft hole 751 is formed in a right-front corner of the arm part 75. The shaft hole 751 is circular in a plan view and penetrates the right-front corner of the arm part 75 vertically. A shaft 95 provided on the frame 91 is inserted through the shaft hole 751. The shaft 95 extends upward from the top surface of the frame 91. The arm part 75 is thus pivotally movably supported by the shaft 95. The support part 752 is provided to the left of the shaft hole 751. The support part 752 rotatably supports the conveying roller 69. The contact part 753 is disposed on a right-rear corner of the arm part 75. The contact part 753 is a protrusion that protrudes downward from a bottom surface of the right-rear corner of the arm part 75. One end of a helical spring 99 (see FIG. 11) is fixed to the arm part 75, while the other end is fixed to the frame 91. The helical spring 99 thus urges the arm part 75 in the clockwise direction in a plan view. The contact part 753 contacts the left end of the release rod 74.

The arm part 76 is disposed forward from the right portion of the release rod 74. The arm part 76 has an L-shape in a plan view. The arm part 76 is supported on the frame 91 so as to be capable of pivoting between the first position and the second position. The arm part 76 includes a shaft hole 761, a support part 762, and a contact part 763. The shaft hole 761 is disposed in an approximate left-right center region of the arm part 76. The shaft hole 761 is circular in a plan view and penetrates the generally center region of the arm part 76 vertically. A shaft 96 provided on the frame 91 is inserted into the shaft hole 761. The shaft 96 extends upward from the top surface of the frame 91. The arm part 76 is pivotably supported by the shaft 96. The support part 762 is disposed to the left of the shaft hole 761. The support part 762 rotatably supports the conveying roller 68. The contact part 763 is connected to the release rod 74 at a right-rear corner of the arm part 76. One end of a helical spring 97 is fixed to the arm part 76, while the other end is fixed to the frame 91. The helical spring 97 urges the arm part 76 in the clockwise direction in a plan view.

The linking members 72 and 73 and the release rod 74 having the above configuration constitute a toggling mechanism with augmented output. As shown in FIG. 10, a center point P1 of the connecting part 731 and a center point P2 of the shaft 721 are separated by a distance T1. The center point P1 of the connecting part 731 and a center point P3 of the connecting part 732 are separated by a distance T2. In the present embodiment, T1/T2 is 33/38 mm. A line segment L1 connects the center point P1 to the center point P2, and a line segment L2 connects the center point P1 to the center point P3. When the release lever 71 is in its horizontal position, an angle formed by the line segments L1 and L2 on the side opposite the release lever 71 will be called an angle θ1. A line segment L3 connects the center point P3 of the connecting part 732 to a distal endpoint P4 of the release rod 74. When the release lever 71 is in the horizontal position, an angle formed by the line segments L2 and L3 on the side of the release lever 71 is an angle θ2. In the present embodiment, the angles θ1 and θ2 are 110° and 144°, respectively.

The urging force of the torsion spring 77 in the present embodiment is 17.4 N when the release lever 71 is in the horizontal position. A distance from the center of the shaft 921 to the distal end 712A of the tail part 712 is a distance T3, and a distance from the center of the shaft 921 to the left end of the release lever 71 is a distance T4. In the present embodiment, T3/T4 (i.e., the link ratio) is 14.5/82.5 mm. Preferably, the value of each parameter (T1/T2, θ1, θ2, urging force of the torsion spring 77, and T3/T4) should be optimized. The values of the parameters are optimized in the present embodiment With this configuration, the load received when the user moves the release lever 71 from the horizontal position to the vertical position is low and stable throughout the entire operation. Note that the values given for these parameters are merely one example.

Next, operations of the release mechanism 70 will be described with reference to FIGS. 10 through 14.

When the user pivots the release lever 71 from its horizontal position (see FIGS. 10 and 11) in the clockwise direction in a front view, the distal end 712A of the tail part 712 contacts the left portion on the top surface of the linking member 72. While contacted by the distal end 712A, the linking member 72 pivots counterclockwise in a front view about the shaft 721. The linking member 73 pivots clockwise in a front view along with the pivotal movement of the linking member 72. At this time, the linking member 73 pushes the release rod 74 leftward, causing the release rod 74 to move to the left side. Accordingly, as shown in FIG. 13, the arm part 75 pivots counterclockwise in a plan view about the shaft 95 along with the leftward movement of the release rod 74. The arm part 76 also pivots counterclockwise in a plan view about the shaft 96 as the release rod 74 moves leftward. The user pivotally moves the release lever 71 clockwise in a front view until the release lever 71 has moved to its vertical position (see FIGS. 12 and 13).

Figure 12:
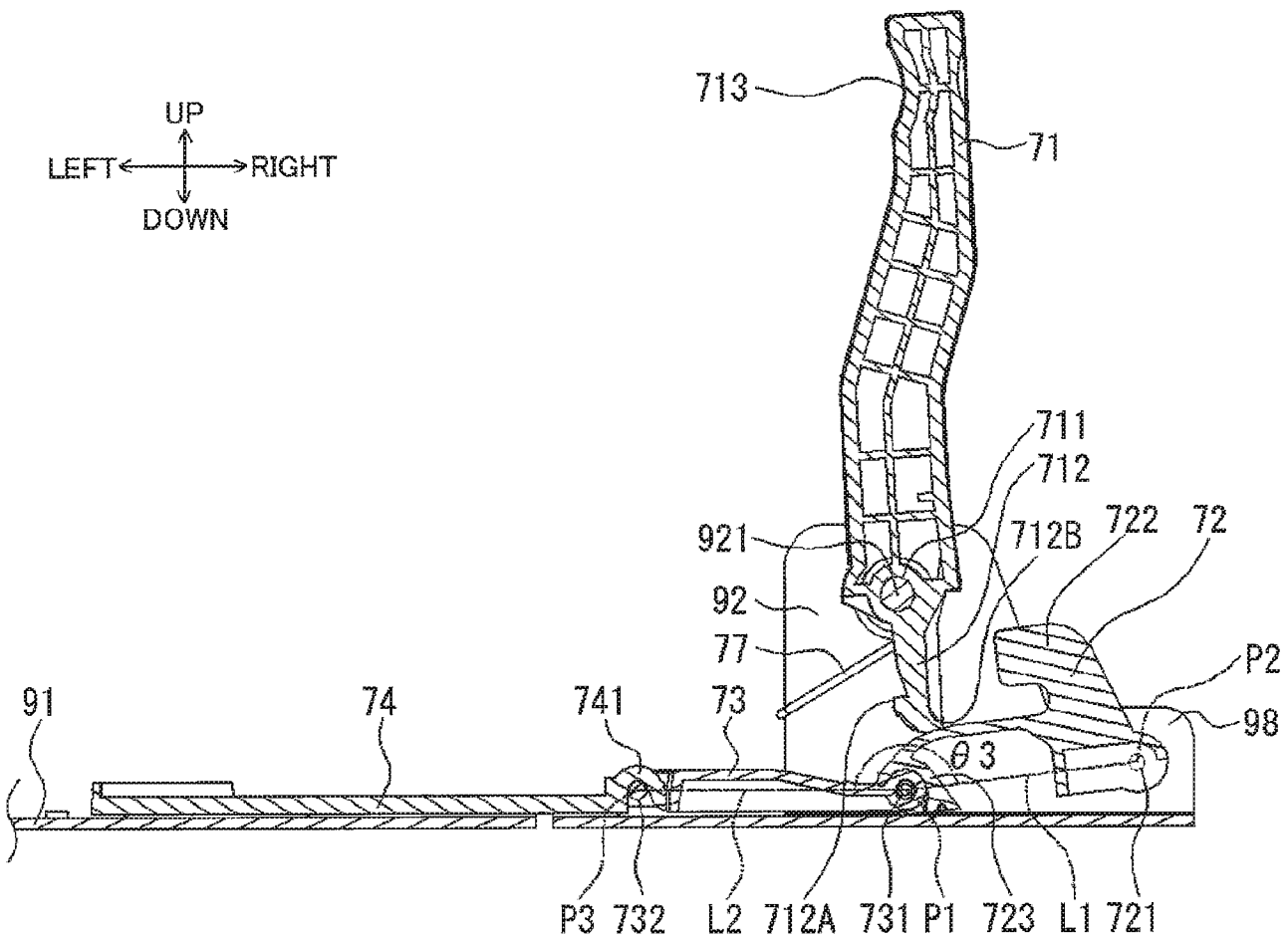
FIG. 12 is a vertical cross-sectional view of the release lever in a vertical position.

When the release lever 71 is in the vertical position, the line segments L1 and L2 form an angle θ3 on the release lever 71 side, as shown in FIG. 12. The angle θ3 is preferably smaller than 180°. In the present embodiment, the angle θ3 is 173°. With this arrangement, a rightward force applied to the release rod 74 acts toward the frame 91 side. Therefore, the toggling mechanism (the linking members 72 and 73 and the release rod 74) does not apply a pivoting force to the release lever 71 when the release lever 71 is in the vertical position. Accordingly, the operation of the toggling mechanism can restrict the release lever 71 in the vertical position from automatically returning to the horizontal position.

Figure 14:
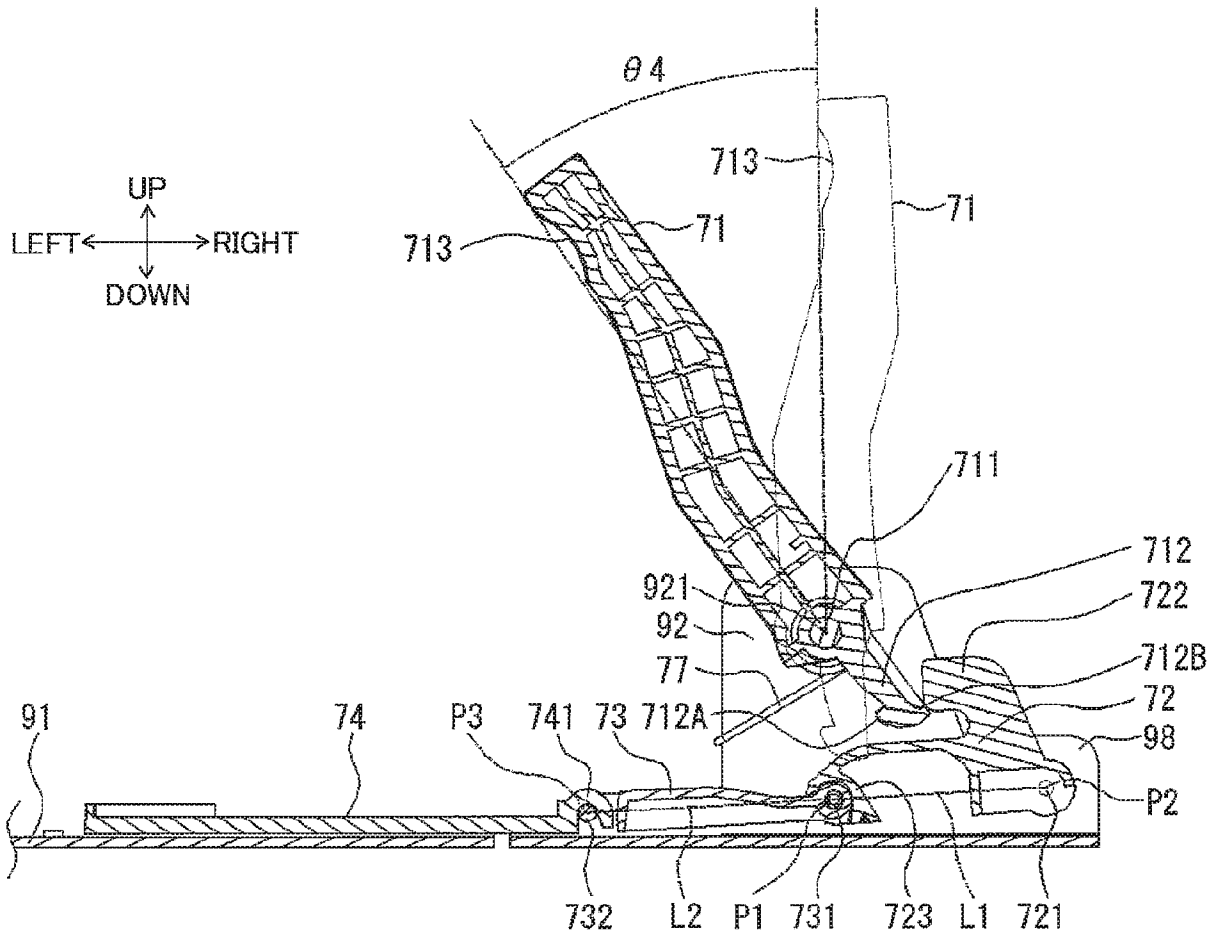
FIG. 14 is a vertical cross-sectional view of the release lever in an intermediate position.

When the user pivots the release lever 71 in the vertical position (see FIGS. 12 and 13) counterclockwise in a front view, a distal end 712B on the top surface of the tail part 712 contacts the guide part 722 of the linking member 72. While in contact with the distal end 712B, the linking member 72 pivots clockwise in a front view about the shaft 721. The linking member 73 pivots counterclockwise in a front view along with the pivotal movement of the linking member 72. As a result, the center points P1, P2, and P3 are positioned along a straight line, as shown in FIG. 14. Hereinafter, the position of the release lever 71 when the center points P1, P2, and P3 are linearly aligned will be called an intermediate position. The angle over which the release lever 71 pivots when moving from the vertical position to the intermediate position is an angle θ4. The angle θ4 is preferably large. In the present embodiment, the angle θ4 is approximately 600.

When the center point P1 is moved toward the release lever 71 from the line connecting the center point P2 and center point P3, the linking member 72 applies a force to the release lever 71 for pivoting the release lever 71 counterclockwise in a front view. That is, the toggling mechanism does not apply a pivoting force to the release lever 71 while the release lever 71 is at or between the vertical position and intermediate position. The structure of the present embodiment applies a force for maintaining the release lever 71 in the vertical position until the release lever 71 has pivoted by the angle θ4 from the vertical position in the counterclockwise direction in a front view because the torsion spring 77 constantly applies an urging force to the release lever 71 for pivoting the release lever 71 clockwise in a front view. As an example, the user may inadvertently contact the release lever 71 while the release lever 71 is in the vertical position. Even in such a case, the operation of the toggling mechanism can restrict the release lever 71 from automatically moving back to the horizontal position until the release lever 71 has pivoted more than angle θ4 from the vertical position.

Figure 11:
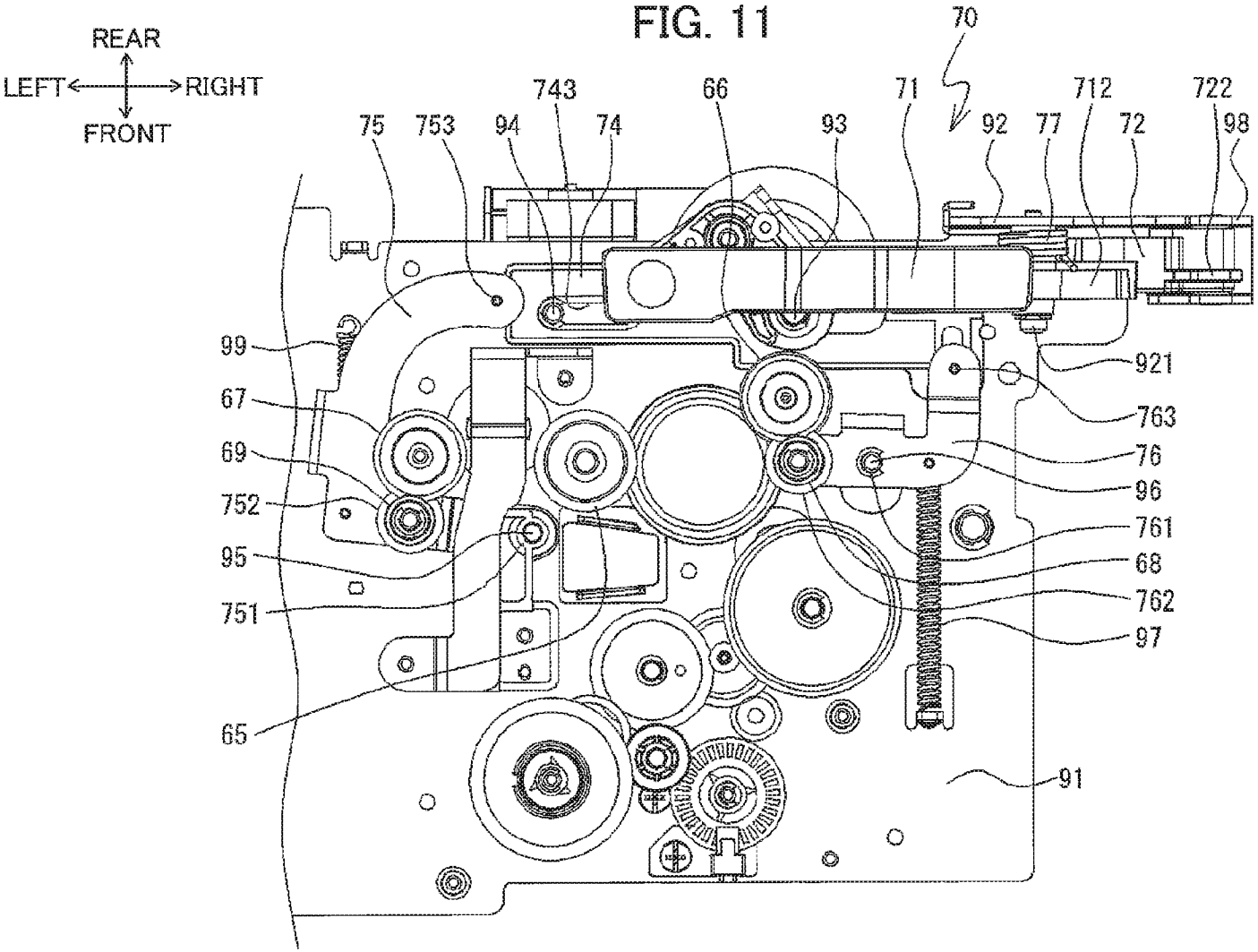
FIG. 11 is a plan view of the release mechanism, wherein the release lever is in the horizontal position.

When the user pivotally move the release lever 71 counterclockwise in a front view from the intermediate position (see FIG. 14), the linking member 72 pivots clockwise in a front view about the shaft 721 while in contact with the release lever 71. The linking member 73 pivots counterclockwise in a front view along with the pivotal movement of the linking member 72. Consequently, the linking member 73 pulls the release rod 74 rightward, thereby moving the release rod 74 to the right side. Hence, as shown in FIG. 11, the arm part 75 pivots clockwise in a plan view about the shaft 95 along with the rightward movement of the release rod 74. The arm part 76 also pivots clockwise in a plan view about the shaft 96 along with the rightward movement of the release rod 74.

When the release lever 71 has moved to the horizontal position, the release lever 71 is in contact with the linking member 72, as shown in FIG. 10. Thus, the linking member 72 can restrict the release lever 71 from pivoting further clockwise in a front view. Accordingly, the operations of the toggling mechanism and the torsion spring 77 can restrict the release lever 71 in the horizontal position from automatically moving to the vertical position.

Next, a first load center of gravity G1 and a second load center of gravity G2 will be described with reference to FIG. 6.

As described earlier, the first pressing parts 81, 82, and 83 press downward on the ribbon cassette 90 mounted in the ribbon-mounting section 30 when the body cover 12 is placed in the closed position. The first load center of gravity G1 is a center of gravity of load that the ribbon cassette 90 applies to the respective first pressing parts 81, 82, and 83 when the body cover 12 is in the closed position. As described earlier, the second pressing part 84 presses downward on the tape cassette 80 mounted in the tape-attachment section 20 when the body cover 12 is in the closed position. The second load center of gravity G2 is a center of gravity of load that the tape cassette 80 applies to the second pressing part 84 when the body cover 12 is in the closed position.

Here, how to find the position of the first load center of gravity G1 according to the present embodiment will be described.

The load that the ribbon cassette 90 applies to the first pressing parts 81, 82, and 83 when the body cover 12 is placed in the closed position will be called forces F1, F2, and F3, respectively. The centers of gravity of the loads that the ribbon cassette 90 applies to the first pressing parts 81, 82, and 83 when the body cover 12 is in the closed position will be called vertices α1, α2, and α3, respectively (see FIG. 6). Points β1, β2, and β3 are defined according to the following expressions (1)-(3).

$$F1\times L\alpha1\beta3=F2\times L\alpha2\beta3 \quad (1)$$

$$F2\times L\alpha2\beta1=F3\times L\alpha3\beta1 \quad (2)$$

$$F3\times L\alpha3\beta2=F1\times L\alpha1\beta2 \quad (3)$$

Here, Lα1β3 denotes the distance between vertex α1 and point β3. Lα2β3 denotes the distance between vertex α2 and point 133. Lα2β1 denotes the distance between vertex α2 and point β1. Lα3β1 denotes the distance between vertex α3 and point β3. Lα3β2 denotes the distance between vertex α3 and point β2. Lα1β2 denotes the distance between vertex α1 and point β2. The first load center of gravity G1 is an intersecting point of the three lines connecting the points β1, β2, and β3 found in the expressions (1)-(3) and the corresponding vertices α1, α2, and α3 of the opposing angles.

As described above, the sponges 812, 822, and 832 are formed of the same material in the present embodiment. Further, the sponges 812, 822, and 832 are compressed by the same amount when the body cover 12 is in the closed position. Hence, the same force is applied to the respective sponges 812, 822, and 832 when the body cover 12 is in the closed position. Thus, the present embodiment satisfies the following expression (4).

$$F1=F2=F3 \quad (4)$$

From the expressions (1) through (4), it can be deduced that the following expressions (5)-(7) are satisfied.

$$L\alpha1\beta1=L\alpha2\beta1 \quad (5)$$

$$L\alpha2\beta2=L\alpha3\beta2 \quad (6)$$

$$L\alpha3\beta3=L\alpha1\beta3 \quad (7)$$

From the expressions (5) through (7), it is clear that the first load center of gravity G1 in the present embodiment corresponds to the center of gravity of a triangle formed by connecting the vertices α1, α2, and α3.

Next, the method of finding the second load center of gravity G2 in the present embodiment will be described. When the body cover 12 is in the closed position, the helical springs 845 and 846 apply forces F4 and F5, respectively, to the plate part 841. Points α4 and α5 respectively denote centers of the helical springs 845 and 846 in a plan view. The second load center of gravity G2 falls on a line segment connecting the points α4 and α5. The second load center of gravity G2 is specified by the following expression (8).

$$F4\times LG2\alpha4=F5\times LG2\alpha5 \quad (8)$$

Here, LG2α4 denotes the distance between the second load center of gravity G2 and point α4. LG2α5 denotes the distance between the second load center of gravity G2 and point α5.

As described above, a load of the same magnitude is applied to the helical springs 845 and 846 when the body cover 12 is in the closed position. Hence, the present embodiment satisfies expression (9) below.

$$F4=F5 \quad (9)$$

From the expressions (8) and (9), it can be seen that an expression (10) below is satisfied.

$$LG2\alpha4=LG2\alpha5 \quad (10)$$

Hence, the expression (10) indicates that the second load center of gravity G2 in the present embodiment matches a center point between the point α4 and point α5.

Next, a general formula for finding the first load center of gravity G1 and second load center of gravity G2 will be described.

An XY coordinate plane will be defined as extending in the left-right and front-rear directions. The first load center of gravity G1 will have coordinates (X0, Y0). The printing device 1 will be presumed to have at least one first pressing part. It will be presumed that the ribbon cassette 90 applies load to a specific point on the at least one first pressing part when the body cover 12 is in the closed position. Here, the specific point will have coordinates (Xk, Yk), where k=1, 2, 3, . . . and the largest value of k is equivalent to the number of specific points. There may be a plurality of specific points for a single first pressing part. When the body cover 12 is in the closed position, the ribbon cassette 90 applies load to the first pressing part at the specific point (Xk, Yk) having a magnitude of Fk, where k=1, 2, 3, . . . . From these conditions, the first load center of gravity G1 is the point that satisfies an expression (11) below.

$$F1\times\{(X1,Y1)-(X0,Y0)\}+F2\times\{(X2,Y2)-(X0,Y0)\}+F3\times\{(X3,Y3)-(X0,Y0)\}+\ldots=(0,0) \quad (11)$$

The expression (11) can be applied to the second load center of gravity G2 by replacing the first pressing part with the second pressing part and replacing the ribbon cassette 90 with the tape cassette 80.

Next, a specific area C0 on the opposing surface 123 of the body cover 12 will be described with reference to FIG. 6.

Referring to FIG. 6, a first location A1 is a part of the first extension parts 5L and 5R on the opposing surface 123, the part being located at the leftmost and rearmost in the first extension parts 5L and 5R. In the present embodiment, the first location A1 is the left-rear edge of a connecting part between the first extension part 5L and the body cover 12. A second location A2 is a part of the second extension parts 7L and 7R on the opposing surface 123, the part being located at the leftmost and frontmost in the second extension parts 7L and 7R. In the present embodiment, the second location A2 is the left-front edge of a connection part between the second extension part 7L and the body cover 12. A third location A3 is a part of the first extension parts 5L and 5R on the opposing surface 123, the part being located at the rightmost and rearmost in the first extension parts 5L and 5R. In the present embodiment, the third location A3 is the right-rear edge of a connecting part between the first extension part 5R and the body cover 12. A fourth location A4 is a part of the second extension parts 7L and 7R on the opposing surface 123, the part being located at the rightmost and frontmost in the second extension parts 7L and 7R. In the present embodiment, the fourth location A4 is the right-front edge of a connecting part between the second extension part 7R and the body cover 12. A fifth location A5 is a part (position) of the second extension part 7L on the opposing surface 123, the part being located at the rightmost and frontmost in the second extension part 7L. In the present embodiment, the fifth location A5 is the right-front edge of a connecting part between the second extension part 7L and the body cover 12. A sixth location A6 is a part (position) of the second extension part 7R on the opposing surface 123, the part being located at the leftmost and frontmost in the second extension part 7R. In the present embodiment, the sixth location A6 is the left-front edge of a connecting part between the second extension part 7R and the body cover 12.

Put another way, the first location A1 is a point on the first extension parts 5L and 5R that is positioned closest to the rear edge of the body cover 12 in the front-rear direction and closest to the left edge of the body cover 12 in the left-right direction. The second location A2 is a point on the second extension parts 7L and 7R that is positioned closest to the front edge of the body cover 12 in the front-rear direction and closest to the left edge of the body cover 12 in the left-right direction. The third location A3 is a point on the first extension parts 5L and 5R that is positioned closest to the rear edge of the body cover 12 in the front-rear direction and closest to the right edge of the body cover 12 in the left-right direction. The fourth location A4 is a point on the second extension parts 7L and 7R that is closest to the front edge of the body cover 12 in the front-rear direction and closest to the right edge of the body cover 12 in the left-right direction. The fifth location A5 is a point on the second extension part 7L that is positioned closest to the front edge of the body cover 12 in the front-rear direction and closest to the right edge of the body cover 12 in the left-right direction. The sixth location A6 is a point on the second extension part 7R that is positioned closest to the front edge in the front-rear direction and closest to the left edge in the left-right direction.

A first virtual line K1 passes through the first location A1 and the second location A2. A second virtual line K2 passes through the third location A3 and the fourth location A4. A third virtual line K3 passes through the first location A1 and the third location A3. A fourth virtual line K4 passes through the second location A2 and the fourth location A4. A fifth virtual line K5 passes through the third location A3 and the fifth location A5. A sixth virtual line K6 passes through the first location A1 and the sixth location A6.

The specific area C0 is positioned on the right side of the first virtual line K1, the left side of the second virtual line K2, the front side of the third virtual line K3, and the rear side of the fourth virtual line K4. In other words, the specific area C0 is enclosed by the first virtual line K1, the second virtual line K2, the third virtual line K3, and the fourth virtual line K4 in a plan view. The specific area C0 includes a first specific area C1, and a second specific area C2. The first specific area C1 is a portion of the specific area C0 on the left side of the fifth virtual line K5. In other words, the first specific area C1 is defined by the first virtual line K1, third virtual line K3, fourth virtual line K4, and fifth virtual line K5 in a plan view. The second specific area C2 is a portion of the specific area C0 on the right side of the sixth virtual line K6. In other words, the second specific area C2 is defined by the second virtual line K2, third virtual line K3, fourth virtual line K4, and sixth virtual line K6 in a plan view.

As described above, the first extension parts 5L and 5R constitutes portions of the hinge units 3L and 3R, respectively. Thus, the vertical distance of the first extension parts 5L and 5R from the housing body 11 is fixed regardless of whether the body cover 12 is in the open position or closed position. The vertical distance relative to the housing body 11 will hereinafter be called a part height. The second extension parts 7L and 7R are respectively engaged in the second recessed parts 6L and 6R when the body cover 12 is in the closed position. Hence, the part height of the second extension parts 7L and 7R is fixed when the body cover 12 is in the closed position. With this arrangement, the specific area C0 is surrounded by the first extension parts 5L and 5R and the second extension parts 7L and 7R whose part heights are fixed. Hence, the height of parts constituting the body cover 12 that are positioned within the specific area C0 are less likely to be displaced than the height of parts outside the specific area C0.

Since the first extension parts 5L and 5R constitute parts of the hinge units 3L and 3R, the part heights of the first extension parts 5L and 5R are less likely to be displaced than the part heights of the second extension parts 7L and 7R. The first specific area C1 is surrounded by the second extension part 7L and the first extension parts 5L and 5R, while the second specific area C2 is surrounded by the second extension part 7R and the first extension parts 5L and 5R. Accordingly, the height of parts constituting the body cover 12 that fall within the first specific area C1 and second specific area C2 is less likely to be displaced than the height of parts outside the first specific area C1 and second specific area C2. Further, the heights of parts in the body cover 12 that fall along virtual line segments connecting each of the locations A1-A6 are less likely to be displaced than the height of parts at other locations.

Next, primary features of the first load center of gravity G1 and second load center of gravity G2 and locations at which other components and the like are disposed in the present embodiment will be described with reference to FIGS. 3 and 6.

As shown in FIG. 6, the first load center of gravity G1 and second load center of gravity G2 in the present embodiment fall within the first specific area C1 and second specific area C2, respectively. Note that it is sufficient that the first load center of gravity G1 and second load center of gravity G2 fall within the specific area C0.

Referring to FIG. 6, the shortest distance between the first load center of gravity G1 and the first virtual line K1 is a distance T5, while the shortest distance between the second load center of gravity G2 and second virtual line K2 is a distance T6. In the present embodiment, a relationship between the distance T5 and distance T6 satisfies the following expression (12).

$$T6<T5 \quad (12)$$

In the present embodiment, the magnitude of load applied at the second load center of gravity G2 when the body cover 12 is in the closed position is greater than the magnitude of load applied at the first load center of gravity G1. By satisfying the expression (12) above, this arrangement achieves balance between the pressure applied by the first pressing parts 81, 82, and 83 to the ribbon cassette 90 and the pressure applied by the second pressing part 84 to the tape cassette 80. Note that the distance T5 is preferably 0. In this case, it is even more preferable that the distance T6 be 0. This arrangement can provide even better stability between the pressure applied by the first pressing parts 81, 82, and 83 to the ribbon cassette 90 and the pressure applied by the second pressing part 84 to the tape cassette 80. Note that the present disclosure does not necessitate that the expression (12) be satisfied.

The retaining parts 811, 821, and 831 are all disposed on the body cover 12 within the specific area C0. Hence, the first pressing parts 81, 82, and 83 are all fixed to the body cover 12 within the specific area C0. One end of each of the helical springs 845 and 846 is fixed to the body cover 12 inside the specific area C0. Thus, the second pressing part 84 is fixed to the body cover 12 within the specific area C0.

The shaft part 854 is disposed on the body cover 12 inside the specific area C0. Specifically, the shaft part 854 is disposed inside the first specific area C1 and the second specific area C2. Hence, the third pressing part 85 is fixed to the body cover 12 within the first specific area C1 and the second specific area C2. The support part 861 is disposed on the body cover 12 inside the specific area C0. Specifically, the support part 861 is disposed inside the first specific area C1. Thus, the third pressing part 86 is fixed to the body cover 12 within the first specific area C1.

The first protruding part 87L is disposed on the body cover 12 inside the specific area C0 and forward of the first pressing parts 81, 82, and 83. The second protruding part 87R is disposed on the body cover 12 inside the specific area C0 and forward of the second pressing part 84.

As shown in FIG. 3, the first contact part 46L is disposed on the attachment surface 11A at a position opposing the specific area C0 in the opposing surface 123 and forward of the ribbon-mounting section 30. The second contact part 46R is disposed on the attachment surface 11A at a position opposing the specific area C0 in the opposing surface 123 and forward of the tape-attachment section 20.

As shown in FIG. 6, the body cover 12 is equally divided into six regions D1-D6 juxtaposed and arrayed in the left-right direction in order from left to right. The second extension part 7L is arranged in the region D2, and the second extension part 7R is arranged in the region D5. The region D2 is the left-right center region of the regions D1-D3 constituting the left half of the body cover 12. The region D5 is the left-right center region of the regions D4-D6 constituting the right half of the body cover 12.

The first extension parts 5L and 5R are arranged farther rearward than the first load center of gravity G1 and second load center of gravity G2. The second extension parts 7L and 7R are arranged forward of the first load center of gravity G1 and second load center of gravity G2.

Figure 15:
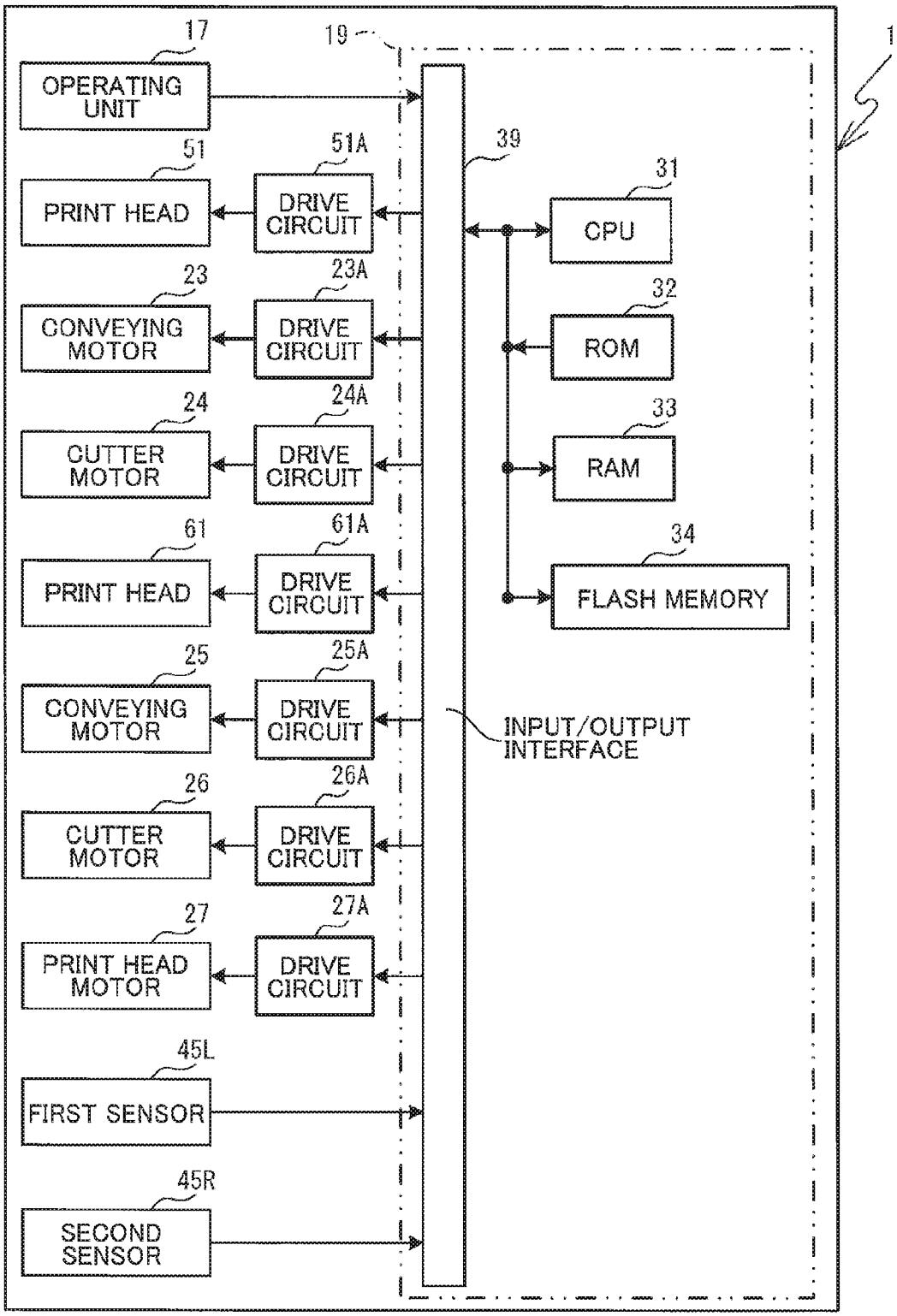
FIG. 15 is a block diagram showing an electrical configuration of the printing device according to the embodiment.

Next, the electrical structure of the printing device 1 will be described with reference to FIG. 15.

The printing device 1 includes a control board 19. The control board 19 is provided in a right-rear section inside the housing body 11. The control board 19 includes a CPU 31, a ROM 32, a RAM 33, a flash memory 34, and an input/output interface 39. These components of the control board 19 are interconnected via a data bus. The CPU 31 is configured to control various operations of the printing device 1. The ROM 32 stores programs that the CPU 31 can execute for controlling the printing device 1. The RAM 33 is configured to store temporary data. The flash memory 34 is a non-volatile storage device.

The input/output interface 39 is connected to the operating unit 17, the first sensor 45L, the second sensor 45R, and drive circuits 51A, 23A, 24A, 61A, 25A, 26A, and 27A. The operating unit 17 is configured to receive input operations from the user. The drive circuit 51A is an electronic circuit for driving the print head 51. The drive circuit 23A is an electronic circuit for driving the conveying motor 23. The drive circuit 24A is an electronic circuit for driving the cutting motor 24. The drive circuit 61A is an electronic circuit for driving the print head 61. The drive circuit 25A is an electronic circuit for driving the conveying motor 25. The drive circuit 26A is an electronic circuit for driving the cutter motor 26. The drive circuit 27A is an electronic circuit for driving the print head motor 27. The first sensor 45L is configured to detect whether the first contact part 46L is pushed. The second sensor 45R is configured to detect whether the second contact part 46R is pushed.

Next, a monitoring process executed by the CPU 31 will be described with reference to FIG. 16.

The CPU 31 is configured to start the monitoring process when the power to the printing device 1 is turned on by reading and executing a program stored in the ROM 32.

In S1 at the beginning of the monitoring process, the CPU 31 determines whether or not the first contact part 46L has been pushed by the first protruding part 87L based on the ON/OFF signal outputted from the first sensor 45L. The CPU 31 determines that the first protruding part 87L has pushed the first contact part 46L (S1: YES) when detecting an ON signal from the first sensor 45L. In this case, the CPU 31 then determines in S2 whether the second protruding part 87R has pushed the second contact part 46R based on the ON/OFF signal outputted from the second sensor 45R. The CPU 31 determines that the second protruding part 87R has pushed the second contact part 46R (S2: YES) when detecting an ON signal from the second sensor 45R. When both the first contact part 46L and second contact part 46R have been pushed downward by the corresponding first protruding part 87L and second protruding part 87R, the body cover 12 is in the closed position. At this time, in S3 the CPU 31 begins a print control process described later (see FIG. 17), provided that a print control process is not currently being executed, and subsequently returns to S1.

The CPU 31 determines in S1 that the first protruding part 87L is separated from the first contact part 46L (S1: NO) when detecting an OFF signal from the first sensor 45L. In this case, the CPU 31 advances to S4. Similarly, when the CPU 31 determines in S2 that the second protruding part 87R is separated from the second contact part 46R by detecting an OFF signal from the second sensor 45R (S2: NO), the CPU 31 advances to S4. In S4 the CPU 31 halts the print control process if a print control process is being executed. When at least one of the first contact part 46L and second contact part 46R is separated from the corresponding first protruding part 87L and second protruding part 87R, the body cover 12 is in the open position. When the body cover 12 is moved to the open position, the CPU 31 halts the print control process. After completing the process in S4, the CPU 31 returns to S1.

Next, the print control process executed by the CPU 31 will be described with reference to FIG. 17.

Figure 16:
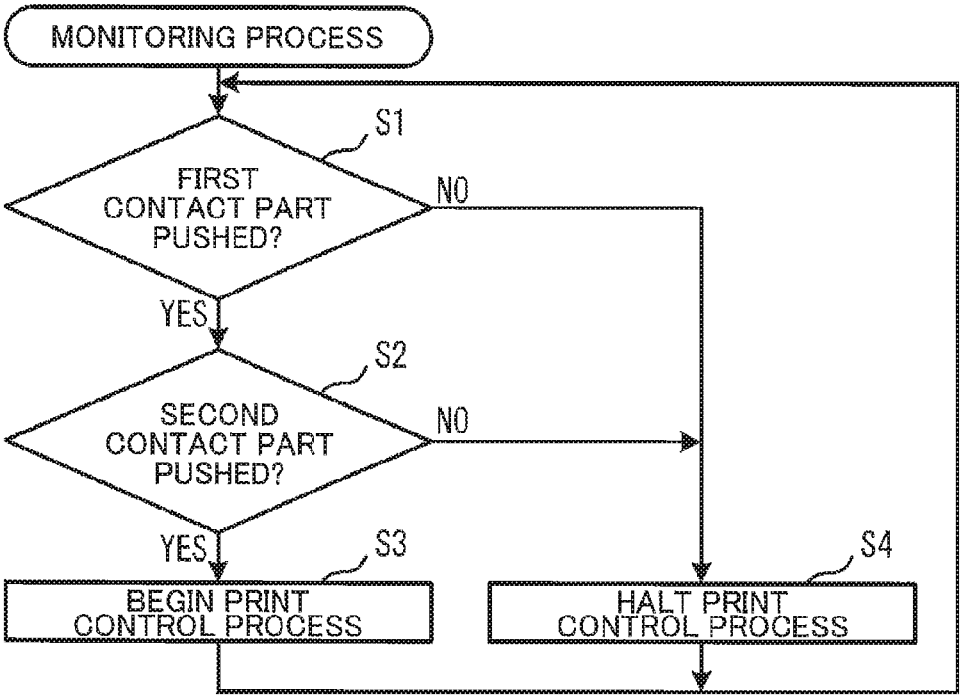
FIG. 16 is a flow chart showing steps performed in a monitoring process.

The CPU 31 executes the print control process when executing step S3 in the monitoring process of FIG. 16 by reading and executing a program stored in the ROM 32.

Here it is assumed that the user has performed the following steps prior to the CPU 31 executing the print control process. Specifically, the user mounts the tape cassette 80 in the tape-attachment section 20 when printing on the tape 8 and mounts the ribbon cassette 90 in the ribbon-mounting section 30 when printing on the tubing 9. Subsequently, the user moves the release lever 71 to its vertical position, mounts the tubing 9 in the tube-attachment unit 40, and returns the release lever 71 to its horizontal position. After performing the above steps, the user then moves the body cover 12 to its closed position. From this state, the CPU 31 can initiate the print control process when executing step S3 of the monitoring process.

Note that the CPU 31 will not initiate the print control process while the body cover 12 is in the open position since step S3 of the monitoring process will not be executed at such a time. If the body cover 12 is displaced to the open position while the print control process is being executed, the CPU 31 halts the print control process in step S4 of the monitoring process (see FIG. 16). After initiating the print control process, the CPU 31 executes the print control process and monitoring process in parallel.

In S11 at the beginning of the print control process, the CPU 31 determines whether a command has been issued to print on the tape 8. The user can input a command to the printing device 1 to print on the tape 8 by performing an operation on the operating unit 17. If the user has inputted a command to print on the tape 8, the CPU 31 determines in S11 that a command for printing on the tape 8 has been issued (S11: YES). In S12 the CPU 31 controls the operations of the printing device 1 for printing on the tape 8 (hereinafter called a "tape printing operation").

In the tape printing operation, the CPU 31 controls the drive circuit 23A to drive the conveying motor 23. When the conveying motor 23 is driven, the tape drive shaft 55 rotates and the tape 8 is conveyed by the rotation of the tape drive shaft 55. The CPU 31 also controls the drive circuit 51A to drive the print head 51. When the print head 51 is driven, characters are printed through the ink ribbon 801 onto the tape 8 as the tape 8 is being conveyed. The print head 61 prints characters in a positive image on a right surface of the tape 8. Thus, the printed surface of the tape 8 is the right surface. The used ink ribbon 801 is subsequently taken up in the tape cassette 80. When the printing operation on the tape 8 is completed, the CPU 31 controls the drive circuit 51A to halt driving of the print head 51. When the print head 51 is halted, printing on the tape 8 is halted. The CPU 31 controls the drive circuit 23A to halt driving of the conveying motor 23. When the conveying motor 23 is halted, conveyance of the tape 8 is halted, halting take-up of the ink ribbon 801. The CPU 31 controls the drive circuit 24A to drive the cutting motor 24. When the cutting motor 24 is driven, the cutter (not shown) of the tape-cutting unit 21 is driven to cut the tape 8 at a position rearward of the tape discharge hole 14. The CPU 31 then controls the drive circuit 23A to drive the conveying motor 23. Driving the conveying motor 23 causes the cut tape 8 to be discharged from the housing 10 through the tape discharge hole 14. After the tape printing operation is complete in S12, the CPU 31 returns to S11.

If the CPU 31 determines in S11 that a command has not been issued to print on the tape 8 (S11: NO), in S13 the CPU 31 determines whether a command to print on the tubing 9 has been issued. The user can input a command into the printing device 1 for printing on the tubing 9 by performing an operation on the operating unit 17. If a command to print on the tubing 9 was not issued (S13: NO), the CPU 31 returns to S11. However, if a command was inputted into the printing device 1 via the operating unit 17 to print on the tubing 9, the CPU 31 determines in S13 that a command to print on the tubing 9 has been issued (S13: YES). In S14, the CPU 31 controls operations of the printing device 1 to print on the tubing 9 (hereinafter called a "tube printing operation").

In the tube printing operation, the CPU 31 controls the drive circuit 27A to drive the print head motor 27. When the print head motor 27 is driven, the print head 61 is displaced to the printing position. The CPU 31 then controls the drive circuit 25A to drive the conveying motor 25. Driving the conveying motor 25 rotates the conveying rollers 65, 66, and 67 and the ribbon take-up shaft 63. The tubing 9 disposed in the tube-attachment unit 40 is conveyed downstream in the conveying direction by the rotations of the conveying rollers 65, 66, and 67. At this time, unprinted tubing 9 positioned outside of the housing 10 is pulled into the tube-attachment unit 40 through the tubing insertion hole 15 formed in the right surface of the housing 10. The ink ribbon 901 is also pulled out of the ribbon cassette 90 as the ribbon take-up shaft 63 rotates.

Next, the CPU 31 controls the drive circuit 61A to drive the print head 61. When driven, the print head 61 prints characters through the ink ribbon 901 pulled out of the ribbon cassette 90 onto the conveyed tubing 9. The print head 61 prints characters in a positive image on the front surface of the tubing 9. Hence, the printed surface of the tubing 9 is the front surface. The used ink ribbon 901 is taken up inside the ribbon cassette 90. After the tubing 9 has been printed, the CPU 31 controls the drive circuit 61A to halt driving of the print head 61, halting printing on the tubing 9. Next, the CPU 31 controls the drive circuit 25A to halt driving of the conveying motor 25, thereby halting conveyance of the tubing 9 and halting take-up of the ink ribbon 901. The CPU 31 controls the drive circuit 26A to drive the cutter motor 26. Driving the cutter motor 26 drives the cutter 22A to cut the tubing 9 at a position upstream of the tubing discharge hole 16 in the conveying direction. The CPU 31 then controls the drive circuit 25A to drive the conveying motor 25. Driving the conveying motor 25 discharges the cut tubing 9 from the housing 10 through the tubing discharge hole 16. After completing the tube printing operation, the CPU 31 returns to S11.

As described above, the ribbon cassette 90 is mounted in the ribbon-mounting section 30, and the tape cassette 80 is mounted in the tape-attachment section 20. The print head 61 prints on the tubing 9 through the ink ribbon 901. The print head 51 prints on the tape 8 through the ink ribbon 801. Hence, the printing device 1 can support two cassettes and two printing media.

The first extension parts 5L and 5R engage in the first recessed parts 4L and 4R, respectively, when the body cover 12 is in the closed position. The second extension parts 7L and 7R engage in the second recessed parts 6L and 6R, respectively, when the body cover 12 is in the closed position. The first recessed parts 4L and 4R and the second recessed parts 6L and 6R are provided on the housing body 11. Therefore, the part heights of the first extension parts 5L and 5R and second extension parts 7L and 7R are fixed when the body cover 12 is in the closed position. The first pressing parts 81, 82, and 83 protrude downward from the opposing surface 123. When the body cover 12 is in the closed position, the first pressing parts 81, 82, and 83 apply pressure to the ribbon cassette 90 mounted in the ribbon-mounting section 30, thereby maintaining the positioning of the ribbon cassette 90 in the ribbon-mounting section 30. When the body cover 12 is in the closed position, the second pressing part 84 protrudes downward from the opposing surface 123 and applies pressure to the tape cassette 80 mounted in the tape-attachment section 20, thereby maintaining the positioning of the tape cassette 80 in the tape-attachment section 20.

The printing device 1 of the embodiment can support two cassettes and two printing media. Consequently, the size of the body cover 12 in the printing device 1 is larger than in a printing device that supports only one cassette and one printing medium. A larger body cover 12 is more susceptible to warping and other deformation. In the embodiment described above, the specific area C0 is arranged on the right side of the first virtual line K1, the left side of the second virtual line K2, the front side of the third virtual line K3, and the rear side of the fourth virtual line K4. The first virtual line K1 passes through the first location A1 and second location A2, and the second virtual line K2 passes through the third location A3 and fourth location A4. The first location A1 is positioned on the leftmost and rearmost end of the first extension parts 5L and 5R. The second location A2 is positioned on the leftmost and frontmost end of the second extension parts 7L and 7R. The third location A3 is positioned on the rightmost and rearmost end of the first extension parts 5L and 5R. The fourth location A4 is positioned on the rightmost and frontmost end of the second extension parts 7L and 7R. When the body cover 12 is in the closed position, the first extension parts 5L and 5R are respectively engaged in the first recessed parts 4L and 4R, and the second extension parts 7L and 7R are respectively engaged in the second recessed parts 6L and 6R. Accordingly, the part heights at the locations A1-A4 are fixed when the body cover 12 is in the closed position. In other words, the specific area C0 is surrounded by locations whose part heights are fixed. Accordingly, when the printing device 1 deforms, the part height of the body cover 12 within the specific area C0 is less likely to deform than the part height outside the specific area C0. In the present embodiment, the first load center of gravity G1 and second load center of gravity G2 are located within the specific area C0. Accordingly, the pressing parts 81-84 apply uniform pressure to the cassettes 80 and 90 mounted in the mounting sections 20 and 30. Therefore, the printing device 1 can stabilize the positioning of cassettes 80 and 90 mounted in the mounting sections 20 and 30, even when the body cover 12 becomes deformed.

The specific area C0 includes the first specific area C1 and second specific area C2. The first specific area C1 is positioned on the right side of the first virtual line K1 and the left side of the fifth virtual line K5. The fifth virtual line K5 passes through the third location A3 and fifth location A5. The fifth location A5 is positioned on the rightmost and frontmost end of the second extension part 7L. The second specific area C2 is positioned on the left side of the second virtual line K2 and on the right side of the sixth virtual line K6. The sixth virtual line K6 passes through the first location A1 and sixth location A6. The sixth location A6 is positioned on the leftmost and frontmost end of the second extension part 7R. When the body cover 12 is in the closed position, the part heights at the locations A1-A6 are fixed. The first extension parts 5L and 5R respectively engage in the first recessed parts 4L and 4R to configure the hinge units 3L and 3R. Hence, the part heights of the first extension parts 5L and 5R are fixed regardless of whether the body cover 12 is in the closed position or the open position. As a result, the part heights at the first location A1 and third location A3 are less likely to be displaced than the part heights at the second location A2 and the locations A4-A6. Accordingly, the part heights of the body cover 12 within the first specific area C1 and within the second specific area C2 are less likely to be displaced than the part heights outside the first specific area C1 and second specific area C2. The first load center of gravity G1 is located in the first specific area C1, where part heights are unlikely to deviate. The second load center of gravity G2 is located in the second specific area C2 where part heights are unlikely to deviate. Accordingly, the pressing parts 81-84 can apply uniform pressure to the cassettes 80 and 90 mounted in the mounting sections 20 and 30.

The second extension part 7L is disposed in the region D2, and the second extension part 7R in the region D5. The region D2 is the second from the left among the six regions D1-D6 found by equally dividing the body cover 12 into six areas juxtaposed and arrayed in the recited order in the left-right direction. The region D5 is the second from the right among the six regions D1-D6. In other words, the region D2 is the center area of the three regions D1-D3 configured by dividing the left half of the body cover 12 into three equal regions juxtaposed in the left-right direction, and the region D5 is the center area of the three regions D4-D6 configured by dividing the right half of the body cover 12 into three equal regions juxtaposed in the left-right direction. With this arrangement, most of the external force applied to the left half of the body cover 12 is distributed to the second extension part 7L and most of the external force applied to the right half of the body cover 12 is distributed to the second extension part 7R. Therefore, external forces applied to the body cover 12 can be dispersed, suppressing deformation of the body cover 12.

The first sensor 45L can detect when the first protruding part 87L is separated from the first contact part 46L, and the second sensor 45R can detect when the second protruding part 87R is separated from the second contact part 46R. When both the first contact part 46L and second contact part 46R are in contact with the corresponding first protruding part 87L and second protruding part 87R, the body cover 12 is in the closed position. When at least one of the first contact part 46L and second contact part 46R is separated from the corresponding first protruding part 87L and second protruding part 87R, the body cover 12 is in the open position. The pressing parts 81-86 may not be able to apply adequate pressure to the cassettes 80 and 90 mounted in the mounting sections 20 and 30 and to the tubing 9 mounted in the tube-attachment unit 40 when the body cover 12 is in the open position. In such cases, the positioning of the cassettes 80 and 90 mounted in the mounting sections 20 and 30 is not stable, and conveyance of the tubing 9 mounted in the tube-attachment unit 40 is not stable, either. Printing problems could occur if a printing operation were performed in such a state (when the body cover 12 is in the open position). However, the printing device 1 according to the embodiment is configured to initiate a print control process in S3 to execute a tape printing operation or a tube printing operation when the body cover 12 is in the closed position (S1: YES and S2: YES). The printing device 1 is configured to halt the print control process in S4 when the body cover 12 is in the open position (S1: NO or S2: NO). In this way, the printing device 1 according to the present embodiment can suppress printing problems.

When the body cover 12 deforms, the part height of the body cover 12 within the specific area C0 is less likely to be displaced than the part height outside the specific area C0. The first protruding part 87L protrudes downward from the opposing surface 123 at a position inside the specific area C0 and forward of the first pressing parts 81-83. In other words, the first protruding part 87L is disposed near the second extension part 7L at a position where the part height is unlikely to deviate. Accordingly, the first sensor 45L can reliably detect when the first protruding part 87L separates from the first contact part 46L. Similarly, the second sensor 45R can reliably detect when the second protruding part 87R separates from the second contact part 46R.

When the body cover 12 deforms, the part height of the body cover 12 within the specific area C0 is less likely to be displaced than the part height outside the specific area C0. Since the retaining parts 811, 821, and 831 of the first pressing parts 81, 82, and 83 and the helical springs 845 and 846 of the second pressing part 84 are all fixed to the opposing surface 123 of the body cover 12 at positions inside the specific area C0, the part heights of the pressing parts 81-84 are unlikely to fluctuate when the body cover 12 is in the closed position. Accordingly, the printing device 1 can apply reliable pressure to cassettes 80 and 90 mounted in the mounting sections 20 and 30, even when the body cover 12 has become deformed. Thus, the printing device 1 can stabilize the positioning of cassettes 80 and 90 mounted in the mounting sections 20 and 30, even when the body cover 12 is deformed.

When the body cover 12 is in the closed position, the third pressing parts 85 and 86 positioned in the tube-attachment unit 40 apply pressure to the tubing 9 mounted in the tube-attachment unit 40. This pressure stabilizes conveyance of the tubing 9 in the tube-attachment unit 40. When the body cover 12 is deformed, the part height in the specific area C0 is less likely to fluctuate than the part height outside the specific area C0. Since the shaft part 854 and support part 861 of the respective third pressing parts 85 and 86 are fixed to the opposing surface 123 inside the specific area C0, the part heights of the third pressing parts 85 and 86 are unlikely to fluctuate. Hence, the third pressing parts 85 and 86 can apply stable pressure to the tubing 9 mounted in the tube-attachment unit 40. Accordingly, the printing device 1 of the present embodiment can convey the tubing 9 reliably, even when the body cover 12 becomes deformed.

In the depicted embodiment, the attachment surface 11A is an example of "attachment surface" and the housing body 11 is an example of "main body" of the disclosure. The ink ribbon 901 is an example of "first ink ribbon" and the ribbon cassette 90 is an example of "first cassette". The ribbon-mounting section 30 is an example of "first mounting section". The ink ribbon 801 is an example of "second ink ribbon" and the tape cassette 80 is an example of "second cassette". The tape-attachment section 20 is an example of "second mounting section". The tubing 9 is an example of "first print medium" and the print head 61 is an example of "first print part". The tape 8 is an example of "second print medium" and the print head 51 is an example of "second print part". The body cover 12 is an example of "body cover" and the opposing surface 123 is an example of "opposing surface". The first pressing parts 81, 82, and 83 are an example of "first pressing part" and the second pressing part 84 is an example of "second pressing part". The first recessed parts 4L, 4R are an example of a "first engaging part". The second recessed parts 6R, 6L are an example of "second engaging part". The first extension parts 5L, 5R are an example of"third engaging part" and the second extension parts 7L, 7R are an example of "fourth engaging part". The first load center of gravity G1 is an example of "first load center of gravity" and the second load center of gravity G2 is an example of "second load center of gravity".

Further, in the depicted embodiment, the front-rear direction with respect to the body cover 12 is an example of "first direction" and the left-right direction thereof is an example of "second direction". The rear edge, front edge, left edge and right edge of the body cover 12 are an example of "first edge", "second edge", "third edge" and "fourth edge" of the "body cover", respectively.

In the embodiment, the specific area C0 is an example of "specific area." The first virtual line K1, second virtual line K2, third virtual line K3 and fourth virtual line K4 are examples of"first virtual line" "second virtual line" "third virtual line" and "fourth virtual line," respectively. The first location A1, the second location A2, the third location A3 and the fourth location A4 are examples of "first location" "second location" "third location" and "fourth location," respectively.

Further, in the embodiment, the second extension part 7L is an example of "fifth engaging part" and the second extension part 7R is an example of "sixth engaging part" constituting the "fourth engaging part" of the disclosure. The first specific area C1 is an example of a "first specific area" and second specific area C2 is an example of "second specific area". The first virtual line K1 is an example of "fifth virtual line" and the fifth virtual line K5 is an example of "sixth virtual line". The sixth virtual line K6 is an example of "seventh virtual line" and the second virtual line K2 is an example of "eighth virtual line". The second location A2 is an example of "fifth location", and the fifth location A5 is an example of "sixth location". The sixth location A6 is an example of "seventh location" and the fourth location A4 is an example of "eighth location".

Further in the embodiment, the regions D1-D6 are example of "six regions" including "first region", "second region", "third region", "fourth region", "fifth region" and "sixth region" arrayed in the left-right direction. Among the six regions D1-D6, the region D1 is positioned closest to the left edge of the body cover 12, while the region D6 is positioned closest to the right edge of the body cover 12.

Figure 17:
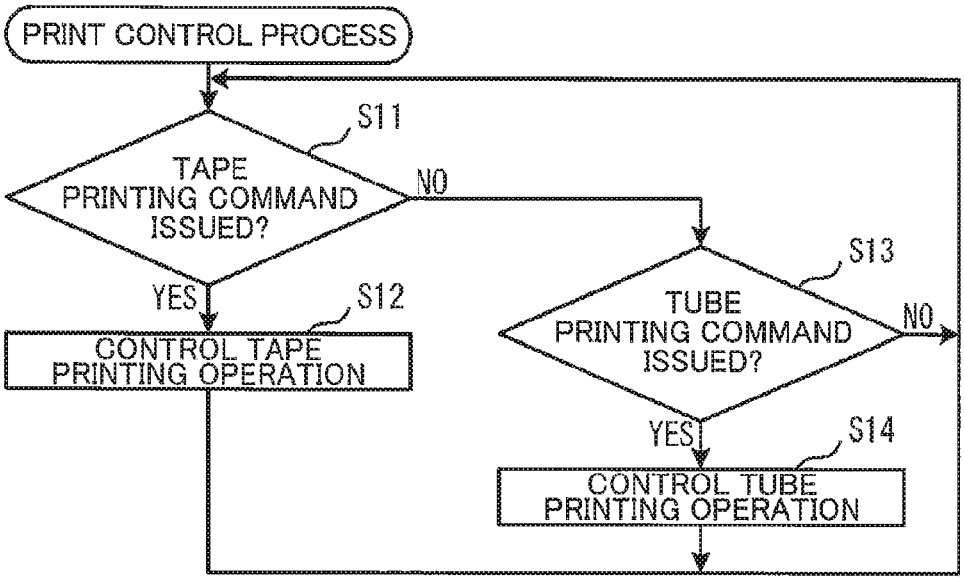
FIG. 17 is a flow chart showing steps performed in a print control process.

Further, in the embodiment, the CPU 31 executing the steps S12 and S14 of the print control operation of FIG. 17 is an example of "controller". The first protruding part 87L is an example of "first protruding part" and the second protruding part 87R is an example of "second protruding part". The first sensor 45L is an example of "first sensor" and the first contact part 46L is an example of "first contact part". The second sensor 45R is an example of "second sensor" and the second contact part 46R is an example of "second contact part". The step S1 of the monitoring process shown in FIG. 16 is an example of "first condition" and the step S2 of the monitoring process of FIG. 16 is an example of "second condition".

Further, in the embodiment, the retaining parts 811, 821, and 831 are an example of "first fixing part" and the helical springs 845 and 846 are an example of "second fixing part". Further, the conveying motor 25 and conveying rollers 65-69 are an example of "conveyor" and the tube-attachment unit 40 is an example of "conveying path". The third pressing parts 85 and 86 are an example of "third pressing part". The shaft part 854 and support part 861 are an example of "third fixing part".

Variations and Modifications

Note that the present disclosure is not limited to the embodiment described above. For example, the number of the first recessed parts 4L and 4R and the first extension parts 5L and 5R is not limited to two each. Further, the first recessed parts 4L and 4R and the first extension parts 5L and 5R need not configure the hinge units 3L and 3R, but need only be engageable with each other. The first extension parts 5L and 5R may be hooks, for example. When there is a plurality of first extension parts, some of the first extension parts may be hooks and others may configure hinges. For example, the first extension part 5L may be a hook, while the first extension part 5R constitutes a hinge. The same variation applies to the second extension parts. In place of the first recessed parts 4L and 4R, first extension parts 5L and 5R, second recessed parts 6L and 6R, and second extension parts 7L and 7R, the printing device 1 may be provided with mutually attracting magnets disposed on the housing body 11 and body cover 12, for example.

The positions of the first recessed parts 4L and 4R, first extension parts 5L and 5R, second recessed parts 6L and 6R, and second extension parts 7L and 7R are not limited to the arrangement described in the embodiment, provided that the first extension parts 5L and 5R and second extension parts 7L and 7R are arranged such that the first load center of gravity G1 and second load center of gravity G2 both fall within the specific area C0. The first extension parts 5L and 5R should be disposed on either the front or rear side of the first load center of gravity G1 and second load center of gravity G2, while the second extension parts 7L and 7R should be disposed on the other front-rear side of the first load center of gravity G1 and second load center of gravity G2. Alternatively, the first extension parts 5L and 5R may be disposed respectively on the left and right edges of the body cover 12, while the second extension parts 7L and 7R are also disposed on the left and right edges of the body cover 12, for example. In this case, the first recessed parts 4L and 4R and second recessed parts 6L and 6R are disposed on the housing body 11 at positions corresponding to the respective first extension parts 5L and 5R and second extension parts 7L and 7R.

Further, the number of first pressing parts 81, 82, and 83 is not limited to three. Also, the first pressing parts 81, 82, and 83 need not be provided with the sponges 812, 822, and 832. In place of the sponges 812, 822, and 832, the first pressing parts 81, 82, and 83 may be provided with elastic members such as springs or rubber members. The printing device 1 may also employ the structure used for the second pressing part 84, the third pressing parts 85 and 86, and the like as the structure of the first pressing parts 81, 82, and 83. The first pressing parts 81, 82, and 83 are not limited to the structures described above, provided that they can apply pressure to the ribbon cassette 90. The positions of the first pressing parts 81, 82, and 83 are also not limited to the arrangement in the embodiment. The first pressing parts 81, 82, and 83 should be arranged at least so that the first load center of gravity G1 falls in the specific area C0.

The number of second pressing part 84 is not limited to one, and the number of helical springs provided with the second pressing part 84 is not limited to two. Further, in place of the helical springs 845 and 846, the second pressing part 84 may be provided with elastic members such as sponges or rubber members. Further, the second pressing part 84 is not limited to having three protruding parts. The protruding parts 842, 843, and 844 may be configured of elastic members such as springs, rubber members, or sponges. The printing device 1 may also employ the structure of the first pressing parts 81, 82, and 83, third pressing parts 85 and 86, and the like in the structure of the second pressing part 84. The second pressing part 84 is not limited to any of the structures described above, provided that the second pressing part 84 can apply pressure to the tape cassette 80. The position of the second pressing part 84 is also not limited to the arrangement described in the embodiment. The second pressing part 84 should be arranged at least so that the second load center of gravity G2 falls within the specific area C0.

The number of the third pressing parts 85 and 86 is not limited to two, and the printing device 1 need not be provided with the third pressing parts 85 and 86. The printing device 1 may also employ the structure used in the first pressing parts 81, 82, and 83, the second pressing part 84, and the like in the structure of the third pressing parts 85 and 86. The third pressing parts 85 and 86 are not limited to the above structures, provided that they can apply pressure to the tubing 9. The positions of the third pressing parts 85 and 86 are not limited to the arrangement described in the embodiment.

The sensors for detecting when the body cover 12 is in the open position are not limited to the first sensor 45L and second sensor 45R of the embodiment. Both of the first sensor 45L and second sensor 45R may be omitted from the printing device 1. The quantity of sensors is preferably set the same as the quantity of second extension parts or the sum of the quantity of first extension parts and the quantity of second extension parts. The positions of the first contact part 46L and second contact part 46R are not limited to the arrangement described in the embodiment, provided that they are capable of detecting when the body cover 12 is in the open position. For example, the first sensor 45L and second sensor 45R may be disposed in the second recessed parts 6L and 6R, respectively.

The tube-attachment unit 40 need not include the expanded part 402. Further, the dimension of the one of the first restricting part 403 and second restricting part 404 in the specific direction may NOT be smaller than the dimension of the expanded part 402 in the specific direction.

The bending unit 100 is not limited to the shape described in the embodiment, provided that the bending unit 100 has a shape capable deforming the tubing 9 at a position upstream relative to the print head 61 in the conveying direction. The bending unit 100 may be rotatably supported. Alternatively, the bending unit 100 may be omitted from the printing device 1 or the printing device 1 may be provided with a plurality of bending units 100. By providing the printing device 1 with a plurality of bending units 100, the printing device 1 can apply greater back tension to the tubing 9.

While the disclosure is described in detail with reference to the specific embodiment thereof while referring to accompanying drawings, it would be apparent to those skilled in the art that many modifications and variations may be made therein without departing from the scope of the disclosure.

What is claimed is:

1. A printing device comprising:

a main body having an attachment surface;

a first mounting section provided as a recess formed in the attachment surface, a first cassette being configured to be detachably mounted in the first mounting section, the first cassette accommodating a first ink ribbon therein;

a second mounting section provided as a recess formed in the attachment surface, the first mounting section and the second mounting section being formed at positions different from each other in the attachment surface, a second cassette being configured to be detachably mounted in the second mounting section, the second cassette accommodating a second ink ribbon therein;

a first print part configured to perform printing on a first print medium through the first ink ribbon;

a second print part configured to perform printing on a second print medium through the second ink ribbon;

a body cover movable between an open position and a closed position relative to the main body, the body cover having an opposing surface configured to oppose the attachment surface, the opposing surface of the body cover in the open position exposing the first mounting section and the second mounting section, the opposing surface of the body cover in the closed position covering the first mounting section and the second mounting section, the body cover having a first edge and a second edge opposite to each other in a first direction parallel to the opposing surface, the body cover having a third edge and a fourth edge opposite to each other in a second direction crossing the first direction and parallel to the opposing surface, the first mounting section being positioned closer to the third edge than the second mounting section is to the third edge in the second direction;

a first pressing part protruding from the opposing surface, the first pressing part protruding toward the first mounting section and being configured to press the first cassette mounted in the first mounting section when the body cover is in the closed position, a first load center of gravity being defined as a center of gravity of load that the first cassette mounted in the first mounting section applies to the first pressing part when the body cover is in the closed position;

a second pressing part protruding from the opposing surface, the second pressing part protruding toward the second mounting section and being configured to press the second cassette mounted in the second mounting section when the body cover is in the closed position, a second load center of gravity being defined as a center of gravity of load that the second cassette mounted in the second mounting section applies to the second pressing part when the body cover is in the closed position;

a first engaging part provided at the main body;

a second engaging part provided at the main body;

a third engaging part provided at the body cover and configured to engage the first engaging part to be rotatable relative thereto when the body cover is in the closed position, the third engaging part being positioned closer to the first edge of the body cover than the first load center of gravity and the second load center of gravity are to the first edge of the body cover in the first direction, the body cover being movable between the open position and the closed position in accordance with rotation of the third engaging part relative to the first engaging part; and a fourth engaging part provided at the body cover and configured to engage the second engaging part when the body cover is in the closed position, the fourth engaging part comprising a fifth engaging part and a sixth engaging part, the fifth engaging part being closer to the third edge of the body cover than the sixth engaging part is to the third edge of the body cover in the second direction, the fourth engaging part being positioned closer to the second edge of the body cover than the first load center of gravity and the second load center of gravity are to the second edge of the body cover in the first direction, the first load center of gravity and the second load center of gravity being located within a specific area on the opposing surface, the specific area being enclosed by a first virtual line, a second virtual line, a third virtual line and a fourth virtual line, the specific area including a first specific area and a second specific area, the first load center of gravity being located within the first specific area and the second load center of gravity being located within the second specific area, the first virtual line passing through a first location and a second location, the second virtual line passing through a third location and a fourth location, the third virtual line passing through the first location and the third location, the fourth virtual line passing through the second location and the fourth location, the first specific area being defined between a fifth virtual line and a sixth virtual line in the second direction, the second specific area being defined between a seventh virtual line and an eighth virtual line in the second direction, the fifth virtual line passing through the first location and a fifth location, the sixth virtual line passing through the third location and a sixth location, the seventh virtual line passing through the first location and a seventh location, the eighth virtual line passing through the third location and an eighth location, the first location being a point on the third engaging part positioned closest to the first edge of the body cover in the first direction and closest to the third edge of the body cover in the second direction, the second location being a point on the fourth engaging part positioned closest to the second edge of the body cover in the first direction and closest to the third edge of the body cover in the second direction, the third location being a point on the third engaging part positioned closest to the first edge of the body cover in the first direction and closest to the fourth edge of the body cover in the second direction, and the fourth location being a point on the fourth engaging part positioned closest to the second edge of the body cover in the first direction and closest to the fourth edge of the body cover in the second direction, and the fifth location being a point on the fifth engaging part positioned closest to the second edge of the body cover in the first direction and closest to the third edge of the body cover in the second direction, the sixth location being a point on the fifth engaging part positioned closest to the second edge of the body cover in the first direction and closest to the fourth edge of the body cover in the second direction, the seventh location being a point on the sixth engaging part positioned closest to the second edge of the body cover in the first direction and closest to the third edge of the body cover in the second direction, and the eighth location being a point on the sixth engaging part positioned closest to the second edge of the body cover in the first direction and closest to the fourth edge of the body cover in the second direction.

2. The printing device as claimed in claim 1, wherein the body cover is equally divided into six regions in the second direction, the six regions including a first region, a second region, a third region, a fourth region, a fifth region and a sixth region arrayed in a recited order in the second direction, the first region being located closest to the third edge of the body cover in the second direction among the six regions, the sixth region being located closest to the fourth edge of the body cover in the second direction among the six regions, the fifth engaging part being provided in the second region and the sixth engaging part being provided in the fifth region.

3. The printing device as claimed in claim 1, further comprising:

a controller configured to control printing operations by the first print part and the second print part;

a first protruding part protruding from the opposing surface of the body cover, the first protruding part being positioned within the specific area;

a second protruding part protruding from the opposing surface of the body cover, the second protruding part being positioned within the specific area at a position closer to the fourth edge than the first protruding part is to the fourth edge in the second direction, the first protruding part and the second protruding part being positioned closer to the second edge of the body cover than the first pressing part is to the second edge of the body cover in the first direction;

a first sensor including a first contact part provided at the attachment surface, the first protruding part being capable of contacting the first contact part when the body cover is in the closed position, the first sensor being configured to detect that the first protruding part is separated from the first contact part; and a second sensor including a second contact part provided at the attachment surface, the second protruding part being capable of contacting the second contact part when the body cover is in the closed position, the second sensor being configured to detect that the second protruding part is separated from the second contact part, wherein:

the body cover is in the closed position when the first contact part is in contact with the first protruding part and the second contact part is in contact with the second protruding part;

the body cover is in the open position when at least one of the first contact part and second contact part is separated from the corresponding one of the first protruding part and the second protruding part; and the controller is further configured to determine whether at least one of a first condition and a second condition is met, the controller being configured to halt the printing operations by the first print part and the second print part in response to a determination that at least one of the first condition and the second condition is met, the controller being configured to determine:

the first condition is met when the first sensor detects that the first protruding part is separated from the first contact part; and the second condition is met when the second sensor detects that the second protruding part is separated from the second contact part.

4. The printing device as claimed in claim 1, wherein the first pressing part comprises a first fixing part fixed at the opposing surface within the specific area, and wherein the second pressing part comprises a second fixing part fixed at the opposing surface within the specific area.

5. The printing device as claimed in claim 1, further comprising:

a conveyor configured to convey a tubing having a tubular shape, the tubing serving as the first print medium;

a conveying path provided as a recess formed in the attachment surface, the conveyor being configured to convey the tubing along the conveying path; and a third pressing part provided at the opposing surface and having a portion configured to be arranged within the conveying path when the body cover is in the closed position, the third pressing part comprising a third fixing part fixed within the specific area on the opposing surface.

6. A printing device comprising:

a main body having an attachment surface;

a first mounting section provided as a recess formed in the attachment surface, a first cassette being configured to be detachably mounted in the first mounting section, the first cassette accommodating a first ink ribbon therein;

a second mounting section provided as a recess formed in the attachment surface, the first mounting section and the second mounting section being formed at positions different from each other in the attachment surface, a second cassette being configured to be detachably mounted in the second mounting section, the second cassette accommodating a second ink ribbon therein;

a first print part configured to perform printing on a first print medium through the first ink ribbon;

a second print part configured to perform printing on a second print medium through the second ink ribbon;

a body cover movable between an open position and a closed position relative to the main body, the body cover having an opposing surface configured to oppose the attachment surface, the opposing surface of the body cover in the open position exposing the first mounting section and the second mounting section, the opposing surface of the body cover in the closed position covering the first mounting section and the second mounting section, the body cover having a first edge and a second edge opposite to each other in a first direction parallel to the opposing surface, the body cover having a third edge and a fourth edge opposite to each other in a second direction crossing the first direction and parallel to the opposing surface, the first mounting section being positioned closer to the third edge than the second mounting section is to the third edge in the second direction;

a first pressing part protruding from the opposing surface, the first pressing part protruding toward the first mounting section and being configured to press the first cassette mounted in the first mounting section when the body cover is in the closed position, a first load center of gravity being defined as a center of gravity of load that the first cassette mounted in the first mounting section applies to the first pressing part when the body cover is in the closed position;

a second pressing part protruding from the opposing surface, the second pressing part protruding toward the second mounting section and being configured to press the second cassette mounted in the second mounting section when the body cover is in the closed position, a second load center of gravity being defined as a center of gravity of load that the second cassette mounted in the second mounting section applies to the second pressing part when the body cover is in the closed position;

a first engaging part provided at the main body;

a second engaging part provided at the main body;

a third engaging part provided at the body cover and configured to engage the first engaging part to be rotatable relative thereto when the body cover is in the closed position, the third engaging part being positioned closer to the first edge of the body cover than the first load center of gravity and the second load center of gravity are to the first edge of the body cover in the first direction, the body cover being movable between the open position and the closed position in accordance with rotation of the third engaging part relative to the first engaging part; and a fourth engaging part provided at the body cover and configured to engage the second engaging part when the body cover is in the closed position, the fourth engaging part comprising a fifth engaging part and a sixth engaging part, the fifth engaging part being closer to the third edge of the body cover than the sixth engaging part is to the third edge of the body cover in the second direction, the fourth engaging part being positioned closer to the second edge of the body cover than the first load center of gravity and the second load center of gravity are to the second edge of the body cover in the first direction, the first load center of gravity and the second load center of gravity being located within a specific area on the opposing surface, the specific area being an area defined by connecting a first location of the third engaging part, a second location of the fourth engaging part, a third location of the third engaging part and a fourth location of the fourth engaging part, the specific area including a first specific area and a second specific area, the first load center of gravity being located within the first specific area and the second load center of gravity being located within the second specific area, the first specific area being defined between a fifth virtual line and a sixth virtual line in the second direction, the second specific area being defined between a seventh virtual line and an eighth virtual line in the second direction, the fifth virtual line passing through the first location and a fifth location, the sixth virtual line passing through the third location and a sixth location, the seventh virtual line passing through the first location and a seventh location, the eighth virtual line passing through the third location and an eighth location, the first location being a point of the third engaging part positioned closest to the first edge of the body cover in the first direction and closest to the third edge of the body cover in the second direction, the second location being a point of the fourth engaging part positioned closest to the second edge of the body cover in the first direction and closest to the third edge of the body cover in the second direction, the third location being a point of the third engaging part positioned closest to the first edge of the body cover in the first direction and closest to the fourth edge of the body cover in the second direction, and the fourth location being a point of the fourth engaging part positioned closest to the second edge of the body cover in the first direction and closest to the fourth edge of the body cover in the second direction, and the fifth location being a point on the fifth engaging part positioned closest to the second edge of the body cover in the first direction and closest to the third edge of the body cover in the second direction, the sixth location being a point on the fifth engaging part positioned closest to the second edge of the body cover in the first direction and closest to the fourth edge of the body cover in the second direction, the seventh location being a point on the sixth engaging part positioned closest to the second edge of the body cover in the first direction and closest to the third edge of the body cover in the second direction, and the eighth location being a point on the sixth engaging part positioned closest to the second edge of the body cover in the first direction and closest to the fourth edge of the body cover in the second direction.

7. The printing device as claimed in claim 6, wherein the body cover is equally divided into six regions in the second direction, the six regions including a first region, a second region, a third region, a fourth region, a fifth region and a sixth region arrayed in a recited order in the second direction, the first region being located closest to the third edge of the body cover in the second direction among the six regions, the sixth region being located closest to the fourth edge of the body cover in the second direction among the six regions, the fifth engaging part being provided in the second region and the sixth engaging part being provided in the fifth region.

8. The printing device as claimed in claim 6, further comprising:

a controller configured to control printing operations by the first print part and the second print part;

a first protruding part protruding from the opposing surface of the body cover, the first protruding part being positioned within the specific area;

a second protruding part protruding from the opposing surface of the body cover, the second protruding part being positioned within the specific area at a position closer to the fourth edge than the first protruding part is to the fourth edge in the second direction, the first protruding part and the second protruding part being positioned closer to the second edge of the body cover than the first pressing part is to the second edge of the body cover in the first direction;

a first sensor including a first contact part provided at the attachment surface, the first protruding part being capable of contacting the first contact part when the body cover is in the closed position, the first sensor being configured to detect that the first protruding part is separated from the first contact part; and a second sensor including a second contact part provided at the attachment surface, the second protruding part being capable of contacting the second contact part when the body cover is in the closed position, the second sensor being configured to detect that the second protruding part is separated from the second contact part, wherein:

the body cover is in the closed position when the first contact part is in contact with the first protruding part and the second contact part is in contact with the second protruding part;

the body cover is in the open position when at least one of the first contact part and second contact part is separated from the corresponding one of the first protruding part and the second protruding part; and the controller is further configured to determine whether at least one of a first condition and a second condition is met, the controller being configured to halt the printing operations by the first print part and the second print part in response to a determination that at least one of the first condition and the second condition is met, the controller being configured to determine:

the first condition is met when the first sensor detects that the first protruding part is separated from the first contact part; and the second condition is met when the second sensor detects that the second protruding part is separated from the second contact part.

9. The printing device as claimed in claim 6, wherein the first pressing part comprises a first fixing part fixed at the opposing surface within the specific area, and wherein the second pressing part comprises a second fixing part fixed at the opposing surface within the specific area.

10. The printing device as claimed in claim 6, further comprising:

a conveyor configured to convey a tubing having a tubular shape, the tubing serving as the first print medium;

a conveying path provided as a recess formed in the attachment surface, the conveyor being configured to convey the tubing along the conveying path; and a third pressing part provided at the opposing surface and having a portion configured to be arranged within the conveying path when the body cover is in the closed position, the third pressing part comprising a third fixing part fixed within the specific area on the opposing surface.

11. A printing device comprising:

a main body having an attachment surface;

a first mounting section provided as a recess formed in the attachment surface, a first cassette being configured to be detachably mounted in the first mounting section, the first cassette accommodating a first ink ribbon therein;

a second mounting section provided as a recess formed in the attachment surface, the first mounting section and the second mounting section being formed at positions different from each other in the attachment surface, a second cassette being configured to be detachably mounted in the second mounting section, the second cassette accommodating a second ink ribbon therein;

a first print part configured to perform printing on a first print medium through the first ink ribbon;

a second print part configured to perform printing on a second print medium through the second ink ribbon;

a conveyor configured to convey a tubing having a tubular shape, the tubing serving as the first print medium;

a conveying path provided as a recess formed in the attachment surface, the conveyor being configured to convey the tubing along the conveying path;

a body cover movable between an open position and a closed position relative to the main body, the body cover having an opposing surface configured to oppose the attachment surface, the opposing surface of the body cover in the open position exposing the first mounting section and the second mounting section, the opposing surface of the body cover in the closed position covering the first mounting section and the second mounting section, the body cover having a first edge and a second edge opposite to each other in a first direction parallel to the opposing surface, the body cover having a third edge and a fourth edge opposite to each other in a second direction crossing the first direction and parallel to the opposing surface;

a first pressing part protruding from the opposing surface, the first pressing part protruding toward the first mounting section and being configured to press the first cassette mounted in the first mounting section when the body cover is in the closed position, a first load center of gravity being defined as a center of gravity of load that the first cassette mounted in the first mounting section applies to the first pressing part when the body cover is in the closed position;

a second pressing part protruding from the opposing surface, the second pressing part protruding toward the second mounting section and being configured to press the second cassette mounted in the second mounting section when the body cover is in the closed position, a second load center of gravity being defined as a center of gravity of load that the second cassette mounted in the second mounting section applies to the second pressing part when the body cover is in the closed position;

a third pressing part provided at the opposing surface and having a portion configured to be arranged within the conveying path when the body cover is in the closed position, the third pressing part comprising a third fixing part;

a first engaging part provided at the main body;

a second engaging part provided at the main body;

a third engaging part provided at the body cover and configured to engage the first engaging part when the body cover is in the closed position, the third engaging part being positioned closer to the first edge of the body cover than the first load center of gravity and the second load center of gravity are to the first edge of the body cover in the first direction; and a fourth engaging part provided at the body cover and configured to engage the second engaging part when the body cover is in the closed position, the fourth engaging part being positioned closer to the second edge of the body cover than the first load center of gravity and the second load center of gravity are to the second edge of the body cover in the first direction, the first load center of gravity and the second load center of gravity being located within a specific area on the opposing surface, the specific area being enclosed by a first virtual line, a second virtual line, a third virtual line and a fourth virtual line, the third fixing part of the third pressing part being fixed within the specific area on the opposing surface, the first virtual line passing through a first location and a second location, the second virtual line passing through a third location and a fourth location, the third virtual line passing through the first location and the third location, the fourth virtual line passing through the second location and the fourth location, the first location being a point on the third engaging part positioned closest to the first edge of the body cover in the first direction and closest to the third edge of the body cover in the second direction, the second location being a point on the fourth engaging part positioned closest to the second edge of the body cover in the first direction and closest to the third edge of the body cover in the second direction, the third location being a point on the third engaging part positioned closest to the first edge of the body cover in the first direction and closest to the fourth edge of the body cover in the second direction, and the fourth location being a point on the fourth engaging part positioned closest to the second edge of the body cover in the first direction and closest to the fourth edge of the body cover in the second direction.

12. The printing device as claimed in claim 11, wherein the third engaging part is engaged with the first engaging part to be rotatable relative thereto, the body cover being movable between the open position and the closed position in accordance with rotation of the third engaging part relative to the first engaging part, wherein:

the fourth engaging part comprises a fifth engaging part and a sixth engaging part, the fifth engaging part being closer to the third edge of the body cover than the sixth engaging part is to the third edge of the body cover in the second direction;

the first mounting section is positioned closer to the third edge than the second mounting section is to the third edge in the second direction; and the specific area includes a first specific area and a second specific area, the first load center of gravity being located within the first specific area and the second load center of gravity being located within the second specific area, the first specific area being defined between a fifth virtual line and a sixth virtual line in the second direction, the second specific area being defined between a seventh virtual line and an eighth virtual line in the second direction, the fifth virtual line passing through the first location and a fifth location, the sixth virtual line passing through the third location and a sixth location, the seventh virtual line passing through the first location and a seventh location, the eighth virtual line passing through the third location and an eighth location, the fifth location being a point on the fifth engaging part positioned closest to the second edge of the body cover in the first direction and closest to the third edge of the body cover in the second direction, the sixth location being a point on the fifth engaging part positioned closest to the second edge of the body cover in the first direction and closest to the fourth edge of the body cover in the second direction, the seventh location being a point on the sixth engaging part positioned closest to the second edge in the first direction and closest to the third edge in the second direction, and the eighth location being a point on the sixth engaging part positioned closest to the second edge in the first direction and closest to the fourth edge in the second direction.

13. The printing device as claimed in claim 12, wherein the body cover is equally divided into six regions in the second direction, the six regions including a first region, a second region, a third region, a fourth region, a fifth region and a sixth region arrayed in a recited order in the second direction, the first region being located closest to the third edge of the body cover in the second direction among the six regions, the sixth region being located closest to the fourth edge of the body cover in the second direction among the six regions, the fifth engaging part being provided in the second region and the sixth engaging part being provided in the fifth region.

14. The printing device as claimed in claim 11, further comprising:

a controller configured to control printing operations by the first print part and the second print part;

a first protruding part protruding from the opposing surface of the body cover, the first protruding part being positioned within the specific area;

a second protruding part protruding from the opposing surface of the body cover, the second protruding part being positioned within the specific area at a position closer to the fourth edge than the first protruding part is to the fourth edge in the second direction, the first protruding part and the second protruding part being positioned closer to the second edge of the body cover than the first pressing part is to the second edge of the body cover in the first direction;

a first sensor including a first contact part provided at the attachment surface, the first protruding part being capable of contacting the first contact part when the body cover is in the closed position, the first sensor being configured to detect that the first protruding part is separated from the first contact part; and a second sensor including a second contact part provided at the attachment surface, the second protruding part being capable of contacting the second contact part when the body cover is in the closed position, the second sensor being configured to detect that the second protruding part is separated from the second contact part, wherein:

the body cover is in the closed position when the first contact part is in contact with the first protruding part and the second contact part is in contact with the second protruding part;

the body cover is in the open position when at least one of the first contact part and second contact part is separated from the corresponding one of the first protruding part and the second protruding part; and the controller is further configured to determine whether at least one of a first condition and a second condition is met, the controller being configured to halt the printing operations by the first print part and the second print part in response to a determination that at least one of the first condition and the second condition is met, the controller being configured to determine:

the first condition is met when the first sensor detects that the first protruding part is separated from the first contact part; and the second condition is met when the second sensor detects that the second protruding part is separated from the second contact part.

15. The printing device as claimed in claim 11, wherein the first pressing part comprises a first fixing part fixed at the opposing surface within the specific area, and wherein the second pressing part comprises a second fixing part fixed at the opposing surface within the specific area.

16. A printing device comprising:

a main body having an attachment surface;

a first mounting section provided as a recess formed in the attachment surface, a first cassette being configured to be detachably mounted in the first mounting section, the first cassette accommodating a first ink ribbon therein;

a second mounting section provided as a recess formed in the attachment surface, the first mounting section and the second mounting section being formed at positions different from each other in the attachment surface, a second cassette being configured to be detachably mounted in the second mounting section, the second cassette accommodating a second ink ribbon therein;

a first print part configured to perform printing on a first print medium through the first ink ribbon;

a second print part configured to perform printing on a second print medium through the second ink ribbon;

a conveyor configured to convey a tubing having a tubular shape, the tubing serving as the first print medium;

a conveying path provided as a recess formed in the attachment surface, the conveyor being configured to convey the tubing along the conveying path;

a body cover movable between an open position and a closed position relative to the main body, the body cover having an opposing surface configured to oppose the attachment surface, the opposing surface of the body cover in the open position exposing the first mounting section and the second mounting section, the opposing surface of the body cover in the closed position covering the first mounting section and the second mounting section, the body cover having a first edge and a second edge opposite to each other in a first direction parallel to the opposing surface, the body cover having a third edge and a fourth edge opposite to each other in a second direction crossing the first direction and parallel to the opposing surface;

a first pressing part protruding from the opposing surface, the first pressing part protruding toward the first mounting section and being configured to press the first cassette mounted in the first mounting section when the body cover is in the closed position, a first load center of gravity being defined as a center of gravity of load that the first cassette mounted in the first mounting section applies to the first pressing part when the body cover is in the closed position;

a second pressing part protruding from the opposing surface, the second pressing part protruding toward the second mounting section and being configured to press the second cassette mounted in the second mounting section when the body cover is in the closed position, a second load center of gravity being defined as a center of gravity of load that the second cassette mounted in the second mounting section applies to the second pressing part when the body cover is in the closed position;

a third pressing part provided at the opposing surface and having a portion configured to be arranged within the conveying path when the body cover is in the closed position, the third pressing part comprising a third fixing part;

a first engaging part provided at the main body;

a second engaging part provided at the main body;

a third engaging part provided at the body cover and configured to engage the first engaging part when the body cover is in the closed position, the third engaging part being positioned closer to the first edge of the body cover than the first load center of gravity and the second load center of gravity are to the first edge of the body cover in the first direction; and a fourth engaging part provided at the body cover and configured to engage the second engaging part when the body cover is in the closed position, the fourth engaging part being positioned closer to the second edge of the body cover than the first load center of gravity and the second load center of gravity are to the second edge of the body cover in the first direction, the first load center of gravity and the second load center of gravity being located within a specific area on the opposing surface, the specific area being an area defined by connecting a first location of the third engaging part, a second location of the fourth engaging part, a third location of the third engaging part and a fourth location of the fourth engaging part, the third fixing part of the third pressing part being fixed within the specific area on the opposing surface, the first location being a part of the third engaging part positioned closest to the first edge of the body cover in the first direction and closest to the third edge of the body cover in the second direction, the second location being a part of the fourth engaging part positioned closest to the second edge of the body cover in the first direction and closest to the third edge of the body cover in the second direction, the third location being a part of the third engaging part positioned closest to the first edge of the body cover in the first direction and closest to the fourth edge of the body cover in the second direction, and the fourth location being a part of the fourth engaging part positioned closest to the second edge of the body cover in the first direction and closest to the fourth edge of the body cover in the second direction.

17. The printing device as claimed in claim 16, wherein the third engaging part is engaged with the first engaging part to be rotatable relative thereto, the body cover being movable between the open position and the closed position in accordance with rotation of the third engaging part relative to the first engaging part, wherein:

the fourth engaging part comprises a fifth engaging part and a sixth engaging part, the fifth engaging part being closer to the third edge of the body cover than the sixth engaging part is to the third edge of the body cover in the second direction;

the first mounting section is positioned closer to the third edge than the second mounting section is to the third edge in the second direction; and the specific area includes a first specific area and a second specific area, the first load center of gravity being located within the first specific area and the second load center of gravity being located within the second specific area, the first specific area being defined between a fifth virtual line and a sixth virtual line in the second direction, the second specific area being defined between a seventh virtual line and an eighth virtual line in the second direction, the fifth virtual line passing through the first location and a fifth location, the sixth virtual line passing through the third location and a sixth location, the seventh virtual line passing through the first location and a seventh location, the eighth virtual line passing through the third location and an eighth location, the fifth location being a point on the fifth engaging part positioned closest to the second edge of the body cover in the first direction and closest to the third edge of the body cover in the second direction, the sixth location being a point on the fifth engaging part positioned closest to the second edge of the body cover in the first direction and closest to the fourth edge of the body cover in the second direction, the seventh location being a point on the sixth engaging part positioned closest to the second edge in the first direction and closest to the third edge in the second direction, and the eighth location being a point on the sixth engaging part positioned closest to the second edge in the first direction and closest to the fourth edge in the second direction.

18. The printing device as claimed in claim 17, wherein the body cover is equally divided into six regions in the second direction, the six regions including a first region, a second region, a third region, a fourth region, a fifth region and a sixth region arrayed in a recited order in the second direction, the first region being located closest to the third edge of the body cover in the second direction among the six regions, the sixth region being located closest to the fourth edge of the body cover in the second direction among the six regions, the fifth engaging part being provided in the second region and the sixth engaging part being provided in the fifth region.

19. The printing device as claimed in claim 16, further comprising:

a controller configured to control printing operations by the first print part and the second print part;

a first protruding part protruding from the opposing surface of the body cover, the first protruding part being positioned within the specific area;

a second protruding part protruding from the opposing surface of the body cover, the second protruding part being positioned within the specific area at a position closer to the fourth edge than the first protruding part is to the fourth edge in the second direction, the first protruding part and the second protruding part being positioned closer to the second edge of the body cover than the first pressing part is to the second edge of the body cover in the first direction;

a first sensor including a first contact part provided at the attachment surface, the first protruding part being capable of contacting the first contact part when the body cover is in the closed position, the first sensor being configured to detect that the first protruding part is separated from the first contact part; and a second sensor including a second contact part provided at the attachment surface, the second protruding part being capable of contacting the second contact part when the body cover is in the closed position, the second sensor being configured to detect that the second protruding part is separated from the second contact part, wherein:

the body cover is in the closed position when the first contact part is in contact with the first protruding part and the second contact part is in contact with the second protruding part;

the body cover is in the open position when at least one of the first contact part and second contact part is separated from the corresponding one of the first protruding part and the second protruding part; and the controller is further configured to determine whether at least one of a first condition and a second condition is met, the controller being configured to halt the printing operations by the first print part and the second print part in response to a determination that at least one of the first condition and the second condition is met, the controller being configured to determine:

the first condition is met when the first sensor detects that the first protruding part is separated from the first contact part; and the second condition is met when the second sensor detects that the second protruding part is separated from the second contact part.

20. The printing device as claimed in claim 16, wherein the first pressing part comprises a first fixing part fixed at the opposing surface within the specific area, and wherein the second pressing part comprises a second fixing part fixed at the opposing surface within the specific area.

* * * * *